US006079131A

United States Patent [19]

Oshina et al.

[11] Patent Number: 6,079,131

[45] Date of Patent: Jun. 27, 2000

[54] OPERATION CONTROL DEVICE FOR THREE-JOINT TYPE EXCAVATOR

[75] Inventors: Morio Oshina; Mitsuo Sonoda, both of Ibaraki-ken; Eiji Egawa, Tsuchiura; Junji Tsumura, Ibaraki-ken, all of Japan

[73] Assignee: Hitachi Construction Machinery Co., Ltd., Tokyo, Japan

[21] Appl. No.: 09/171,019

[22] PCT Filed: Feb. 16, 1998

[86] PCT No.: PCT/JP98/00616

§ 371 Date: Oct. 15, 1998

§ 102(e) Date: Oct. 15, 1998

[87] PCT Pub. No.: WO98/36132

PCT Pub. Date: Aug. 20, 1998

[30] Foreign Application Priority Data

Feb. 17, 1997 [JP] Japan ..... 9-032171

[51] Int. Cl.[7] ..... E02F 3/43; G05D 3/00; G06F 15/46

[52] U.S. Cl. ..... 37/348; 364/424.07; 318/568.11

[58] Field of Search ..... 37/348, 403, 466, 37/195, 907; 414/695–699, 700, 705, 715, 718, 719, 720, 721–735; 364/424.07, 513, 174, 167.01; 172/4, 4.5

[56] References Cited

U.S. PATENT DOCUMENTS 5,019,761 5/1991 Kraft ..... 318/568.11

5,630,317 5/1997 Takamura et al. ..... 60/445

FOREIGN PATENT DOCUMENTS 5-222744 8/1993 Japan .

7-180173 7/1995 Japan .

*Primary Examiner*—Robert E. Pezzuto

*Attorney, Agent, or Firm*—Beall Law Offices

[57] ABSTRACT

Two control lever units 11, 12 for operating a first arm 3, a second arm 4 and a third arm 5 of a 3-articulation work front 2 are provided, and signals 132, 133 from the two control lever units are sent to a controller 131. On condition that a virtual 2-articulation type work front comprising a virtual first arm 13 and a virtual second arm 14 is imaginarily provided and the relationship in movement between the virtual second arm and the actual third arm is set in advance as if both the arms constitute a rigid body together, the controller 131 determines respective command values $\omega_1$, $\omega_2$ and $\omega_3$ for the actual first arm 3, the actual second arm 4 and the actual third arm 5 so that an intended angular speed of the actual third arm is provided by an angular speed of the virtual second arm resulted when the two control lever units are manipulated to function respectively as first operating means 11 for the virtual first arm and second operating means 12 for the virtual second arm 14. The command values are output as driving command signals to proportional pressure reducing valves 129, 130 of a hydraulic drive system. Operators having an ordinary skill can operate the 3-articulation type work front 2 with a similar operating feeling as obtained with 2-articulation type work fronts.

7 Claims, 14 Drawing Sheets

OPERATION CONTROL DEVICE FOR THREE-JOINT TYPE EXCAVATOR

TECHNICAL FIELD

The present invention relates to an operation control system for an excavator of the 3-articulation type, i.e., having three articulations and arms except for a digging bucket, and more particularly to an operation control system for a 3-articulation type excavator which can be operated by using the same operating means as used in a conventional 2-articulation type excavator.

BACKGROUND ART

The structure of a conventional ordinary excavator is shown in FIG. 11. A work front 100 is made up of two members, i.e., a boom 101 and an arm 102. A bucket 103 for use in excavation work is provided at a fore end of the work front 100. The work front 100 is called a 2-articulation type work front because the bucket 103 serving as a main member to carry out the work is positioned by two rotatable structural elements, i.e., the boom 101 and the arm 102. An excavator provided with the work front 100 is called a 2-articulation type excavator.

Meanwhile, the so-called two-piece boom type excavator has been employed recently. One example of the two-piece boom type excavator is shown in FIG. 12. The two-piece boom type excavator is modified from the ordinary excavator, shown in FIG. 11, in that a boom 101 of a work front 100A is divided into two parts, i.e., a first boom 104 and a second boom 105. Here, the work front 100A is called a 3-articulation type work front based on the number of articulations which take part in positioning a bucket 103 , and an excavator provided with the work front 100A is called a 3-articulation type excavator.

The 3-articulation type excavator has an advantage of enabling the work to be easily carried out near an undercarriage of the excavator, which has been difficult for the 2-articulation type excavator. More specifically, although the 2-articulation type excavator can also be operated to take a posture shown in FIG. 11 for bringing the bucket 103 to a position near the undercarriage, the excavation work cannot be performed with the arm 102 positioned so horizontally as illustrated. On the other hand, in the 3-articulation type excavator, the bucket 103 can be brought to a position near the undercarriage with the arm 102 held substantially vertical as shown in FIG. 12, allowing the excavation work to be carried out near the undercarriage. Further, the excavation work in a position away from the undercarriage can be performed up to a farther position than reachable with the 2-articulation type excavator by extending the first boom 104 and the second boom 105 so as to lie almost straight.

Another advantage of the 3-articulation type excavator is in enabling the work front to swing with a reduced swing radius. When the direction of the work front 100A is changed by swinging an upper swing structure 106 for loading dug earth and sand on a dump car or the like, it is difficult for the 2-articulation type excavator to reduce the radius necessary for the swing because the boom 101 has a large overall length. In the 3-articulation type excavator, the radius necessary for the swing can be reduced by raising the first boom 104 to take a substantially vertical posture and making the second boom 105 extend substantially horizontally. This means that the 3-articulation type excavator is more advantageous in carrying out the work in a narrow-space site.

Next, the conventional operating method will be explained. FIG. 13 shows one example of control levers for use in an ordinary 2-articulation type excavator. In normal excavation work, four kinds of operations effected by the boom, the arm, the bucket and the swing are carried out frequently in a combined manner. These four kinds of operations are allocated to two control levers 107, 108 such that each control lever instructs the two kinds of operations. The excavation work is performed by an operator manipulating the respective levers with the left and right hands. As another control lever, there is a (not-shown) travel lever (usually associated with a pedal as well). The travel lever is used independently of the other levers 107, 108 in many cases; hence it is not here taken into consideration.

FIG. 14 shows one example of control levers for use in a 3-articulation type excavator. As mentioned above, the 3-articulation type excavator can be operated to carry out the work over a wide range from a further position to a position nearer to its undercarriage. To realize this, however, the second boom 105 must also be operated in addition to the first boom 104 corresponding to the boom 101 of the 2-articulation type excavator. Since the four kinds of operations are already allocated to the two control levers 107, 108, a seesaw type pedal 109 is newly provided to operate the second boom 105.

Further, JP, A, 7-180173 proposes a control system for a 3-articulation type excavator. According to the proposed control system, two control levers are designed to instruct moving speeds of a bucket end in the X- and Y-directions, respectively, and a predetermined calculation process is executed based on a resultant speed vector signal of those moving speeds. As a result, in leveling work, movement of the bucket end can be controlled continuously over a larger area and the bucket can be moved along a desired path with high accuracy.

DISCLOSURE OF THE INVENTION

With the operating system for the 3-articulation type excavator constructed as explained above, a wider working area can be covered by providing three articulations, but there is a difficulty in continuously operating the work front over such a wider area. In other words, since the second boom 105 is operated upon the pedal 109 being trod down by the operator's foot, it is difficult to operate the second boom 105 with such fine adjustment as obtainable when operating the lever by the hand, and the second boom 105 cannot be operated in match with the first boom 104, the arm 102 and the bucket 103. Accordingly, customary fashion followed in most cases is that the second boom 105 is fixed in an extended state when carrying out the work in a far position, and is fixed in a contracted state when carrying out the work in a position near the undercarriage.

Further, with the control system proposed in JP, A, 7-180173, the first boom, the second boom, the arm and the bucket of the 3-articulation type excavator can be operated by the two control levers, but these control levers are special ones designed to instruct the moving speeds of the bucket end in the X- and Y-directions, respectively, and an operating manner of the control levers is much different from that of the ordinary control levers. Also, there is no function of instructing the swing operation. In addition, the excavator including the proposed control system is specialized to be fit for special work such as leveling, and is not adaptable for normal work such as digging.

An object of the present invention is to provide an operation control system for a 3-articulation type excavator which enables operators having an ordinary skill to operate a 3-articulation type work front with a similar operating feeling as obtained with conventional 2-articulation type work fronts.

While the related art has been described above in connection with, by way of example, the two-piece boom type excavator having a boom divided into two members, a 3-articulation type excavator having an arm divided into two members also has the same functions as the two-piece boom type excavator. Therefore, three members rotatable at their articulations are called a first arm, a second arm and a third arm in the following description for the purpose of more general explanation.

(1) To achieve the above object, according to the present invention, there is provided an operation control system for a 3-articulation type excavator comprising an excavator body, a 3-articulation type work front having a first arm rotatably attached to the excavator body, a second arm rotatably attached to the first arm and a third arm rotatably attached to the second arm, and a hydraulic drive system including a first arm actuator for driving the first arm, a second arm actuator for driving the second arm, and a third arm actuator for driving the third arm, wherein the operation control system comprises two operating means for operating the first arm, the second arm and the third arm, and command calculating means including an imaginarily provided virtual 2-articulation type work front having a virtual first arm and a virtual second arm and a preset relationship in movement between the virtual second arm and the actual third arm for determining respective command values for the actual first arm, the actual second arm and the actual third arm, such that the actual third arm is moved correspondingly to movement of the virtual second arm resulted when the two operating means functions respectively as first operating means for the virtual first arm and second operating means for the virtual second arm, and outputting those command values as driving command signals for the hydraulic drive system.

The present invention intends to, as stated above, propose an operation control system for a 3-articulation type excavator which enables operators having an ordinary skill to operate a 3-articulation type work front. To realize this, according to the present invention, the 3-articulation type excavator is constructed so that three articulations can be operated by only two operating means which are similar to those used in 2-articulation type excavators.

A 2-articulation type excavator, which has been generally employed heretofore, has a first arm rotatable relative to an excavator body and a second arm rotatable relative to the first arm. By rotating the first arm and the second arm, a working device, e.g., a digging bucket, attached to a fore end of the second arm is moved a desired place to carry out excavation or other works. It is guessed that operators can easily operate an excavator if it is such a 2-articulation type excavator. Also, it is readily observed that the operator carries out excavation and other works while looking at just the working device (bucket) and thereabout. The present invention has been made in view of the above-mentioned manner in which the work front has been employed in the past, and the degree of freedom of the work front from the standpoint of mechanism.

More specifically, the fact that the operator carries out excavation work conventionally while looking at just the bucket and thereabout implies that, if the first and second arms of the 2-articulation type work front are driven by two operating means for applying respective rotational angular speeds of the first and second arms, the moving direction and posture of the bucket resulted from manipulating the operating means can be controlled by obtaining visual information of the bucket and thereabout. Accordingly, so long as the operator carries out the work while looking at just the bucket and thereabout, a 3-articulation type work front can be easily operated for excavation work as with the 2-articulation type work front, by envisaging a virtual 2-articulation type work front comprising a virtual first arm and a virtual second arm, and making the actual third arm operate as intended corresponding to movement of the virtual second arm resulted from virtual operation in which the two operating means provide respective rotational angular speeds of the virtual first arm and the virtual second arm.

That the above-mentioned operation can be realized in 3-articulation type work front will be discussed below from the standpoint of mechanism.

In a 2-articulation type work front, apart from swing operation, the fore end of the second arm can be positioned in any desired point on a two-dimensional plane. This is because the 2-articulation type work front has two articulations, i.e., two degrees of freedom. Also, in a 2-articulation type work front, when the fore end of the second arm is positioned in a particular point, the posture (inclination) of the second arm is uniquely determined. This is because positioning the fore end of the second arm in a two-dimensional space utilizes two degrees of freedom. On the other hand, since a 3-articulation type work has three degrees of freedom, the posture (inclination) of the third arm can be freely selected in addition to a position of the fore end of the third arm. It is therefore possible to make the actual third arm operate as intended corresponding to movement of the virtual second arm by setting the relationship in movement between the virtual second arm and the actual third arm in advance.

With the present invention based on the above finding, the command calculating means determines the respective command values for the actual first arm, the actual second arm and the actual third arm so that the actual third arm is moved correspondingly to movement of the virtual second arm, as stated above, whereby operators having an ordinary skill can operate the 3-articulation type work front with a similar operating feeling as obtained with the conventional 2-articulation type work fronts.

(2) In the above (1), preferably, the command calculating means sets the relationship in movement between the virtual second arm and the actual third arm such that the virtual second arm and the actual third arm are moved as if both arms constitute a rigid body together.

By so moving the virtual second arm and the actual third arm are moved as if both arms constitute a rigid body together, the rotational angular speed of the virtual second arm becomes equal to the rotational angular speed of the actual third arm. Accordingly, the rotational angular speed of the virtual second arm becomes is provided as the rotational angular speed of the actual third arm, and hence excavation work can be easily performed by the 3-articulation type work front in a like manner to the 2-articulation type work front.

(3) In the above (1), the command calculating means may set the relationship in movement between the virtual second arm and the actual third arm such that rotational angular speeds of the virtual second arm provide a rotational angular speed of the actual third arm.

With this feature, the rotational angular speed of the virtual second arm becomes is provided as the rotational angular speed of the actual third arm, and hence excavation work can be easily performed by the 3-articulation type work front in a like manner to the 2-articulation type work front.

(4) In the above (1), preferably, the command calculating means calculates respective first angular speed commands for the actual first arm, second arm and third arm from an angular speed command by the first operating means for the virtual first arm based on the relationship in movement between the virtual second arm and the actual third arm, calculates respective second angular speed commands for the actual first arm, second arm and third arm from an angular speed command by the second operating means for the virtual second arm based on the relationship in movement between the virtual second arm and the actual third arm, and determines respective command values for the actual first arm, second arm and third arm by composing the first angular speed commands and the second angular speed commands for the actual first arm, second arm and third arm.

With this feature, as with the above (1), the respective command values for the actual first arm, second arm and third arm can be determined so that the actual third arm is moved correspondingly to movement of the virtual second arm resulted when the two operating means functions respectively as first operating means for the virtual first arm and second operating means for the virtual second arm.

(5) In one embodiment of the above (1), a base end of the virtual first arm of the imaginarily provided 2-articulation type work front is aligned with a base end of the actual first arm. In this embodiment, the command calculating means determines, as a first angular speed command for the actual first arm, an angular speed command by the first operating means for the virtual first arm, calculates respective second angular speed commands for the actual first arm, second arm and third arm from an angular speed command by the second operating means for the virtual second arm based on the relationship in movement between the virtual second arm and the actual third arm, and determines respective command values for the actual first arm, second arm and third arm by composing the first angular speed command for the actual first arm and the second angular speed commands for the actual first arm, second arm and third arm.

For the virtual 2-articulation type work front in which the base end of the virtual first arm is so aligned with the base end of the actual first arm, the respective command values for the actual first arm, second arm and third arm can be determined with a smaller amount of computation than the case where both the base ends are not aligned with each other.

(6) In the above (1), preferably, the command calculating means comprises means for calculating a target speed at a base end of the actual third arm from an angular speed command by the first operating means for the virtual first arm based on the relationship in movement between the virtual second arm and the actual third arm, and calculating respective first angular speed commands for the actual first arm, second arm and third arm from the target speed at the base end of the third arm and the angular speed command by the first operating means, means for calculating a target speed at the base end of the actual third arm from an angular speed command by the second operating means for the virtual second arm based on the relationship in movement between the virtual second arm and the actual third arm, and calculating respective second angular speed commands for the actual first arm, second arm and third arm from the target speed at the base end of the third arm and the angular speed command by the second operating means, and means for determining respective command values for the actual first arm, second arm and third arm by composing the first angular speed commands and the second angular speed commands for the actual first arm, second arm and third arm.

With this feature, as with the above (4), the respective command values for the actual first arm, second arm and third arm can be determined so that the actual third arm is moved correspondingly to movement of the virtual second arm.

(7) Further, in the above (1), the command calculating means includes posture detecting means for detecting a posture of the 3-articulation type work front, and calculates the command values from posture information detected by the posture detecting means and angular speed commands by the first and second operating means.

BEST MODE FOR CARRYING OUT THE INVENTION

Embodiments of the present invention will be described hereunder with reference to the drawings.

To begin with, a first embodiment of the present invention will be described with reference to FIGS. 1 to 6. In this first embodiment, a base end of a virtual first arm is set rearwardly of a base end of a first arm.

Figure 1:
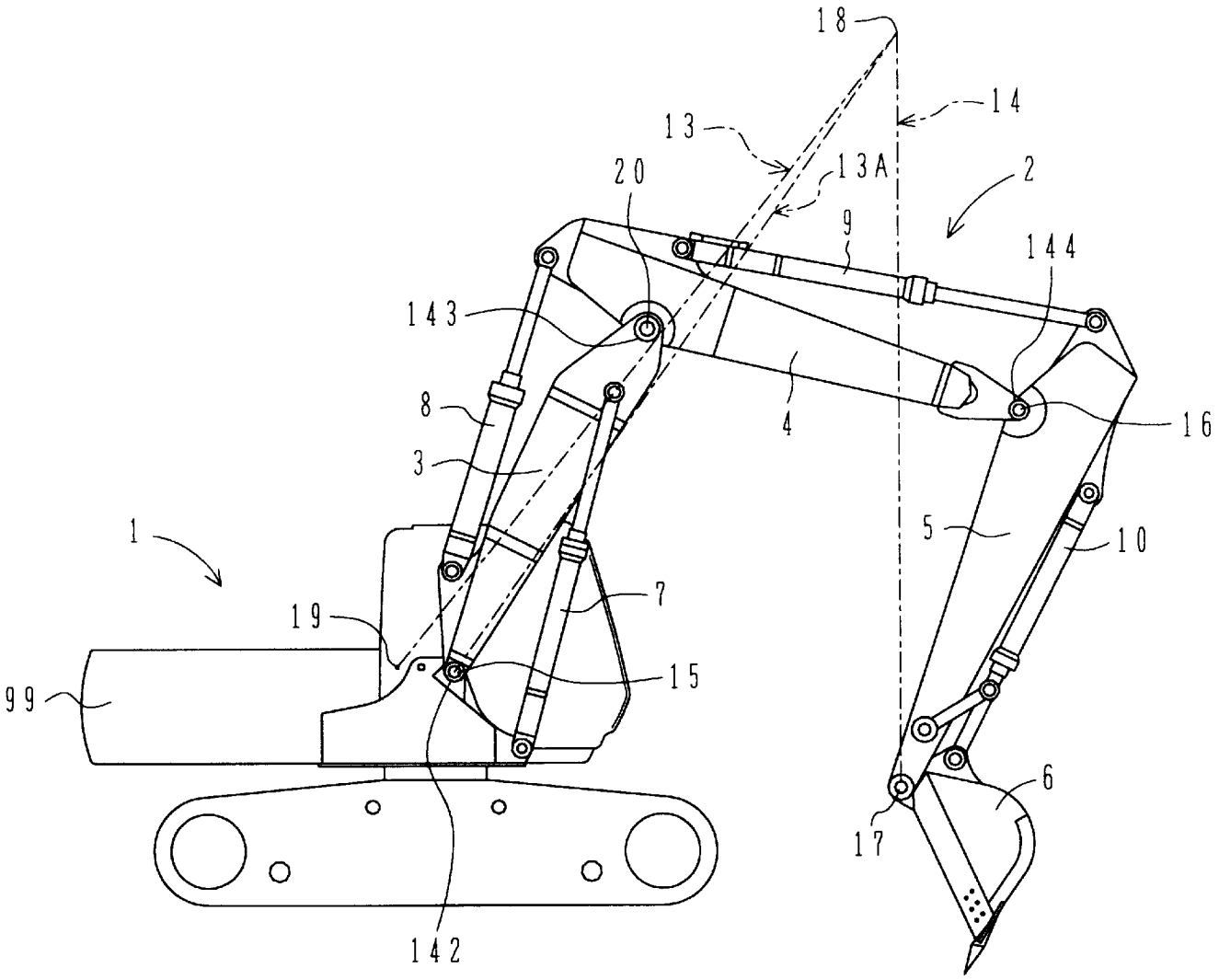
FIG. 1 is a view for explaining the structure of a 3-articulation type excavator to which the present invention is applied.

In FIG. 1, a work front 2 of an excavator 1 is of the 3-articulation type comprising a first arm 3, a second arm 4 and a third arm 5 which are each attached in a vertically rotatable manner at a first articulation 15, a second articulation 20 and a third articulation 16, respectively. The work front 2 is supported at its base end (the first articulation 15) by an excavator body 99 (upper swing structure), and has a digging bucket 6 attached to its distal end, i.e., the fourth articulation 17, in a vertically rotatable manner. The first, second and third arms 3, 4, 5 are driven respectively by first, second and third arm cylinders 7, 8, 9, and the bucket 6 is driven by a bucket cylinder 10.

Figure 2:
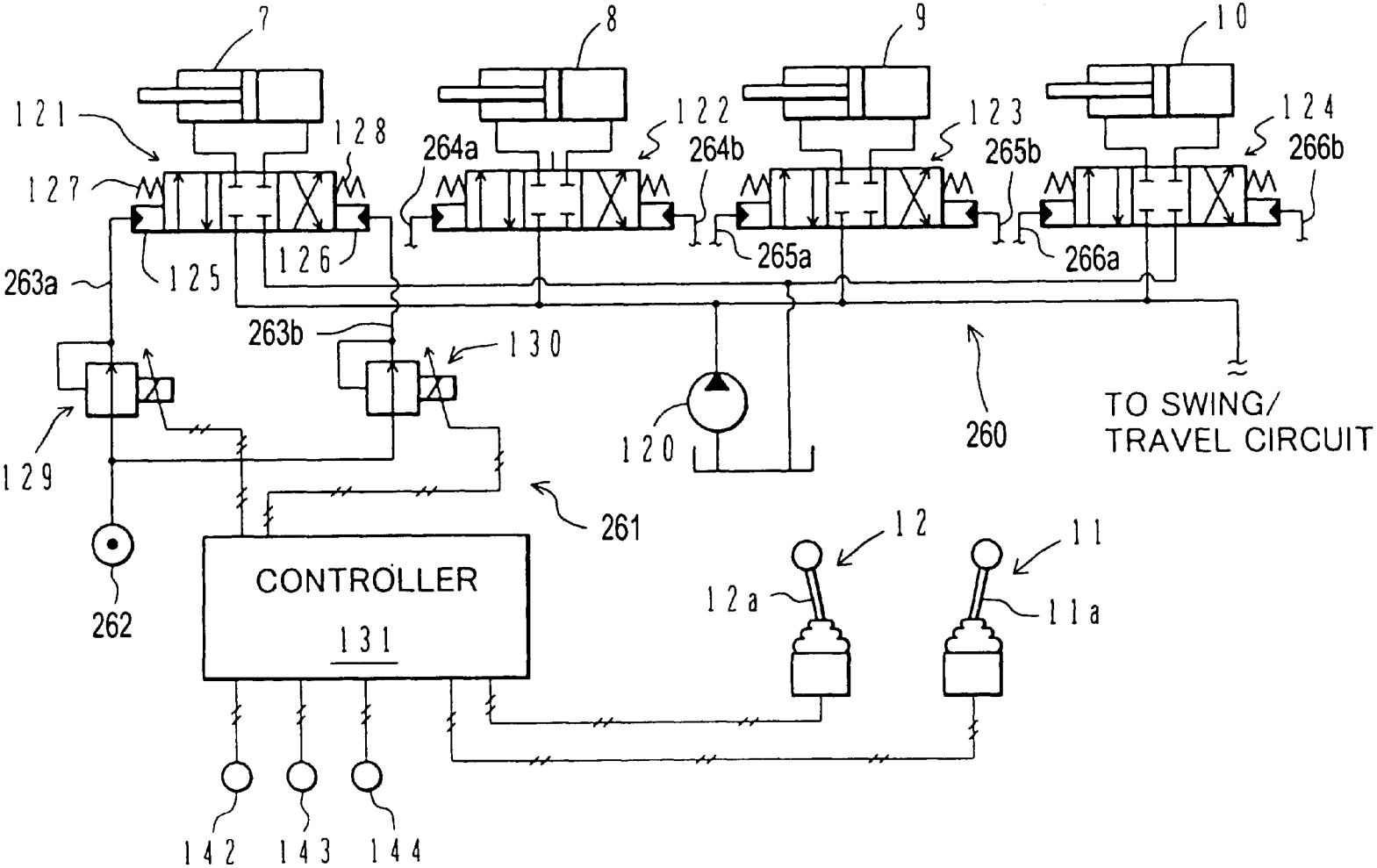
FIG. 2 is a diagram showing the configuration of an operation control system for a 3-articulation type excavator according to one embodiment of the present invention, along with a hydraulic circuit.

FIG. 2 shows one example of a hydraulic circuit. In FIG. 2, denoted by 260 is a hydraulic drive circuit including a first arm cylinder 7, a second arm cylinder 8, a third arm cylinder 9 and a bucket cylinder 10. A hydraulic working fluid delivered from a hydraulic pump 120 is supplied to the first arm cylinder 7, the second arm cylinder 8, the third arm cylinder 9 and the bucket cylinder 10 through flow control valves 121, 122, 123, 124, respectively. In addition, there are provided a swing hydraulic motor and a track hydraulic motor, not shown, which are similarly connected to the hydraulic pump. Although the following description will be made of the first arm cylinder 7, the other cylinders also operate in a like manner.

Further, denoted by 261 is a pilot circuit for introducing pilot pressures to the flow control valves 121, 122, 123 and 124 for operation thereof. The pilot circuit 261 comprises a pilot hydraulic source 262, a pair of pilot lines 263*a*, 263*b* associated with the flow control valve 121 and pairs of similar pilot lines 264*a*, 264*b*; 265*a*, 265*b*; 266*a*, 266*b* (only part of which is shown) associated with the flow control valves 122, 123, 124, and proportional pressure reducing valves 129, 130 disposed respectively in the pilot lines 163*a*, 263*b* and other similar proportional pressure reducing valves (not shown) disposed in the pilot lines 264*a*, 264*b*; 265*a*, 265*b*; 266*a*, 266*b*.

In an inoperative state, the flow control valve 121 is held in a neutral position by being supported by springs 127, 128 and its ports are kept blocked; hence the first arm cylinder 7 is not operated. Pilot pressures adjusted by the proportional pressure reducing valves 129, 130 are introduced to pilot pressure chambers 125, 126 of the flow control valve 121, respectively. When the pilot pressure is established in any of the pilot pressure chambers 125, 126, a valve body of the flow control valve 121 is shifted to a position where balance among a force imposed by the established pilot pressure and resilient forces of the springs 27, 28 is kept. The hydraulic working fluid is supplied to the first arm cylinder 7 at a flow rate depending on the amount of shift of the valve body, causing the first arm cylinder 7 to extend and contract. The above explanation is equally applied to the flow control valves 122, 123 and 124.

The proportional pressure reducing valves 129, 130 and the other not-shown proportional solenoid valves are adjusted by respective drive command signals from a controller 131 which in turn receives operation signals from control lever units 11, 12 and detection signals from angle sensors 142, 143 and 144. The control lever units 11, 12 are each of the electric lever type outputting an electrical signal as the operation signal. When control levers 11*a*, 12*a* of the control lever units 11, 12 are operated, the first arm cylinder 7, the second arm cylinder 8, the third arm cylinder 9 and the bucket cylinder 10 can be driven at any desired speeds depending on input amounts by which the control levers 11*a*, 12*a* are operated. The angle sensors 142, 143 and 144 are attached to the first articulation 15, the second articulation 20 and the third articulation 16, respectively, to detect rotational angles $\theta_1$, $\theta_2$ and $\theta_3$ of the first arm 3, the second arm 4 and the third arm 5. The angle sensors may be each a potentiometer for directly detecting an angle of the corresponding articulation, or may be realized by detecting displacements of the first arm cylinder 7, the second arm cylinder 8 and the third arm cylinder 9, and then calculating the respective rotational angles from the geometrical point.

Figure 3:
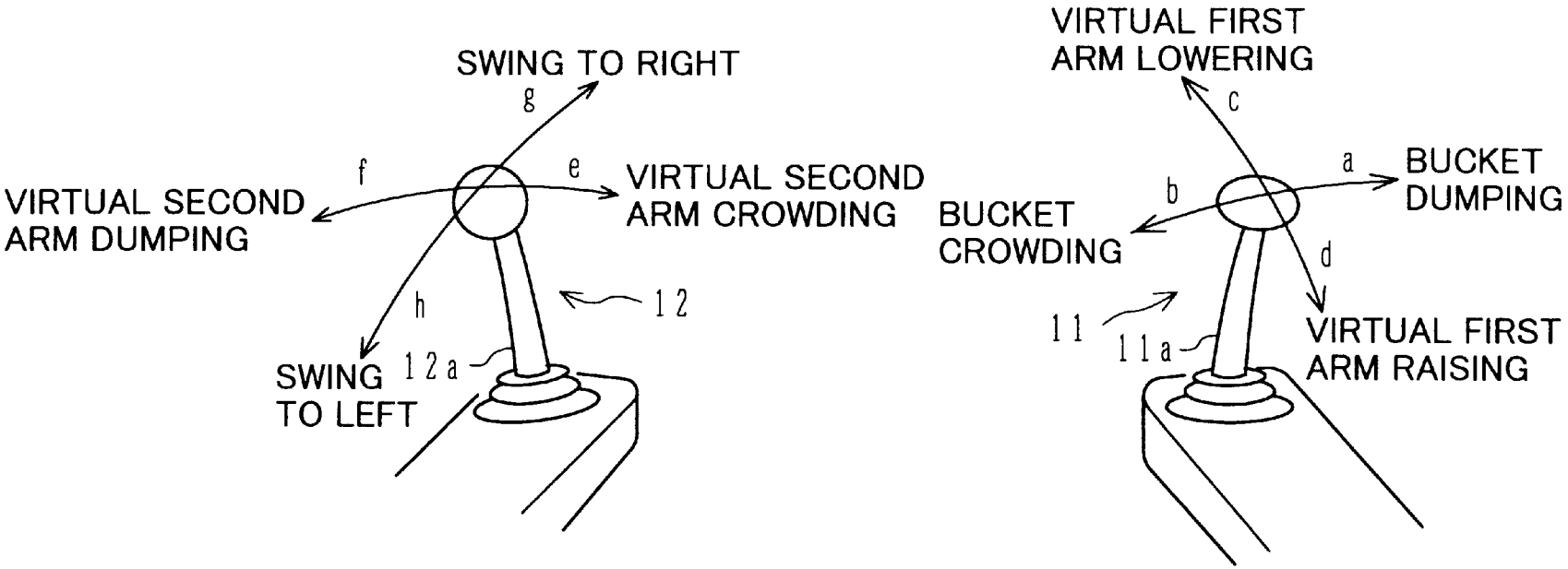
FIG. 3 is an illustration for explaining an operating system used with the operation control system for the 3-articulation type excavator according to one embodiment of the present invention.

FIG. 3 shows details of an operating manner of the control lever units 11, 12.

In FIG. 3, the operation for the bucket and the swing is exactly the same as in the conventional excavator. More specifically, when the control lever 11*a* of the control lever unit 11 disposed on the right side is operated to the right (a), the bucket 6 is moved to the dumping side (unfolding side) at a speed depending on the input amount. Likewise, when the control lever 11*a* is operated to the left (b), the bucket 6 is moved to the crowding side (scooping side) at a speed depending on the input amount. The upper swing structure constituting the excavator body 99 is swung to the right or left at a speed depending on the input amount by operating the control lever 12*a* of the control lever unit 12, which is disposed on the left side, to the front (g) or rear (h).

Conventionally, when the control lever 11*a* of the control lever unit 11 is operated in the forward or rearward direction (c, d), only the first arm 3 is moved in the related art. On the other hand, in the present invention, when the control lever 11*a* of the control lever unit 11 is so operated, a virtual first arm 13 of a 2-articulation type work front, which is a virtual member provided as indicated by a one-dot-chain line in FIG. 1, is moved down or up at a speed depending on the input amount from the control lever 11*a*. Also, conventionally, when the control lever 12*a* of the control lever unit 12 is operated in the leftward or rightward direction (f, e), only the second arm 4 is moved. On the other hand, in the present invention, when the control lever 12*a* of the control lever unit 12 is so operated, a virtual second arm 14 indicated by a one-dot-chain line in FIG. 1 is pulled in (crowded) or pushed out (dumped) at a speed depending on the input amount from the control lever 12*a*.

A description will now be made of the basic principle of the present invention based on which the first arm 3, the second arm 4 and the third arm 5 are moved upon the control lever 11*a* being operated in the forward or rearward direction (c, d) and the control lever 12*a* being operated in the leftward or rightward direction (f, e), as mentioned above, and how to determine command values for the first arm 3, the second arm 4 and the third arm 5.

First, the basic principle of the present invention is below. A 2-articulation type work front having the virtual first arm 13 and the virtual second arm 14 is imaginarily provided, as described above, and the relationship in movement between the virtual second arm 14 and the actual third arm 5 is defined beforehand. The command values for the first arm 3, the second arm 4 and the third arm 5 are then determined so that the operation corresponding to operation of the virtual second arm 14 resulted when the control levers 11*a*, 12*a* are manipulated, is achieved as operation of the actual third arm 5.

In this embodiment, the relationship in movement between the virtual second arm 14 and the actual third arm 5 is defined such that the virtual second arm 14 and the actual third arm 5 are moved as if they constitute a rigid body together. By so defining the relationship in movement between the virtual second arm and the actual third arm, a rotational angular speed of the virtual second arm is made equal to a rotational angular speed of the actual third arm, whereby the rotational angular speed of the virtual second arm is given as the rotational angular speed of the actual third arm.

Also, a base end (virtual first articulation) 19 of the virtual first arm 13 of the imaginarily provided 2-articulation type work front can be set to any desired position with respect to the body 99. In the embodiment shown in FIG. 1, the base end (virtual first articulation) 19 of the virtual first arm 13 is set to a position rearwardly of the base end (first articulation) 15 of the actual first arm 3. Additionally, in FIG. 1, a virtual first arm having a virtual first articulation 19 aligned with the base end (first articulation) 15 of the actual first arm 13 is denoted by 13A.

Further, a length of the virtual first arm 13 (a length $L_0$ of the segment connecting the virtual first articulation 19 and a virtual second articulation 18) and a length of the virtual second arm 14 (a length $L_1$ of the segment connecting the virtual second articulation 18 and a virtual third articulation (bucket articulation) 17) can also be set to any desired values. In this embodiment, $L_0$ and $L_1$ are set to be longer than those of an ordinary 2-articulation type excavator.

Next, the basic principle of the present invention will be described in more detail with reference to FIGS. 4 to 7 while explaining how to determine the command values of the first arm 3, the second arm 4 and the third arm 5.

(A) Case of Operating Virtual First Arm by Control Lever 11*a*

Figure 4:
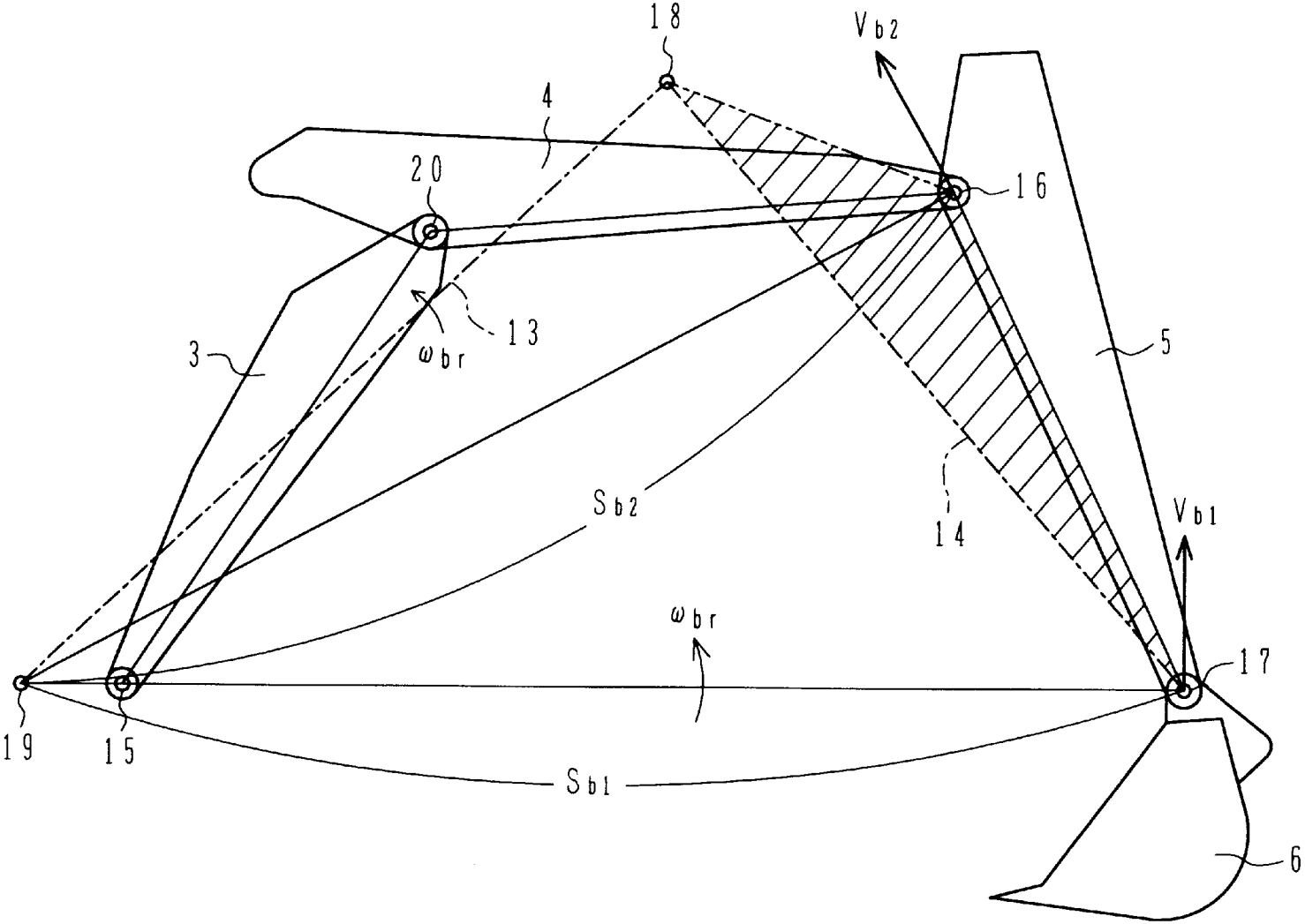
FIG. 4 is a representation for explaining the operating principle of the operation control system for the 3-articulation type excavator according to one embodiment of the present invention.

(A1) Assuming, in FIG. 4, that a command angular speed in the upward direction applied to the virtual first arm 13 by the operation signal from the control lever 11*a* is $\omega_{br}$, if the control lever 12*a* is not manipulated, the virtual second arm 14 is rotated at the same angular speed as the virtual first arm 13 about the virtual first articulation 19. Therefore, a speed (target speed) $V_{b1}$ at which the bucket articulation 17 is to be moved is given by a value of;

$$V_{b1}=S_{b1}\times\omega_{br} \tag{1}$$

in the direction vertical to the segment (length $S_{b1}$) connecting the virtual first articulation 19 and the bucket articulation 17.

Also, because the virtual second arm 14 and the actual third arm 5 are moved as if they constitute a rigid body together (see a hatched area in FIG. 4), a speed (target speed) $V_{b2}$ at which the third articulation 16 is to be moved is given by a value of;

$$V_{b2}=S_{b2}\times\omega_{br} \tag{2}$$

in the direction vertical to the segment (length $S_{b2}$) connecting the virtual first articulation 19 and the third articulation 16.

(A2) The rotational angular speed about the first articulation 15 and the rotational angular speed about the second articulation 20, which are required to give the third articulation 16 the speed $V_{b2}$, are first studied.

Figure 5:
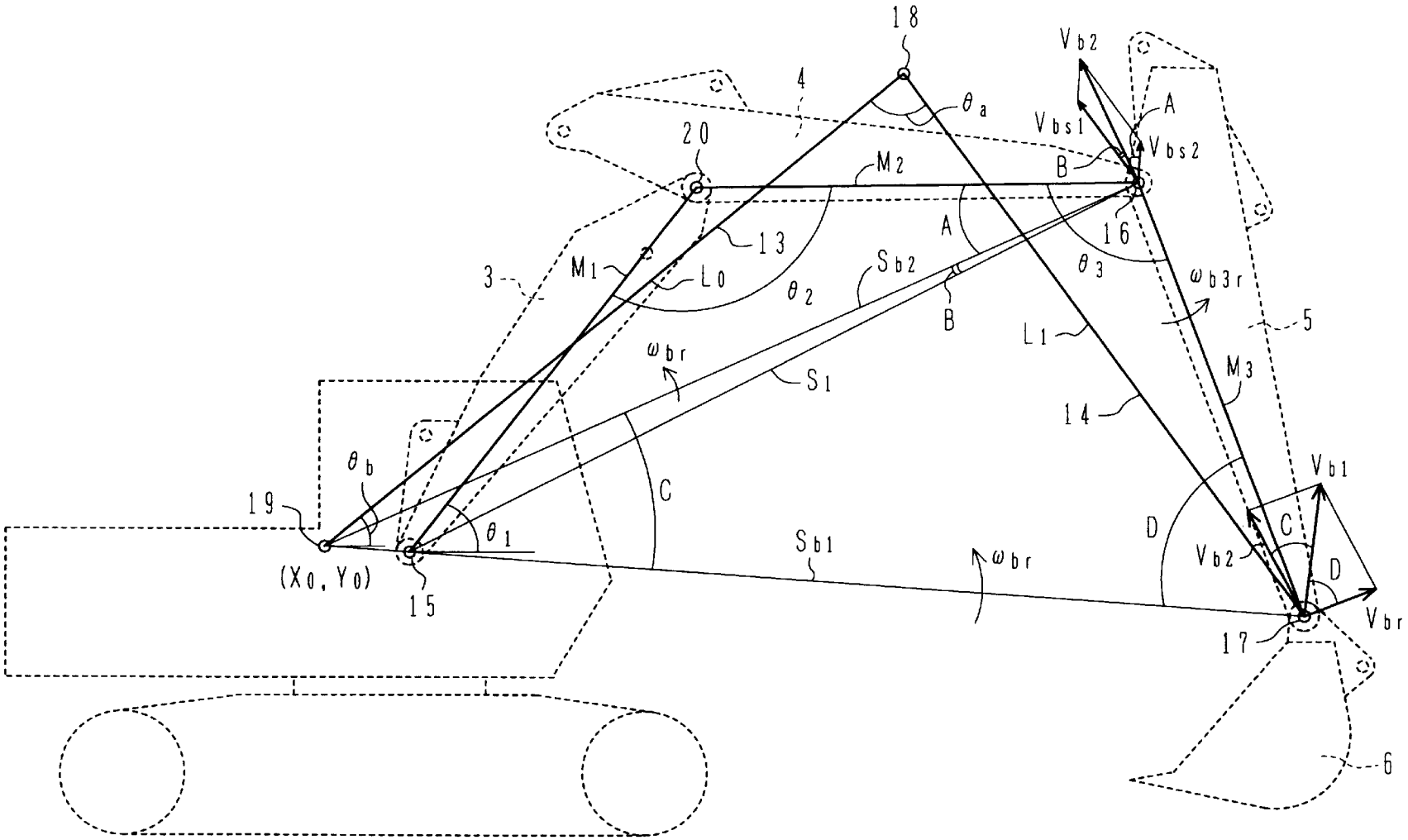
FIG. 5 is a representation for explaining the operating principle of the operation control system for the 3-articulation type excavator according to one embodiment of the present invention.

(A2-1) In FIG. 5, the target speed $V_{b2}$ is decomposed to a component $V_{bs1}$ in the direction vertical to the segment (length $S_1$) connecting the first articulation 15 and the third articulation 16, and a component $V_{bs2}$ in the direction vertical to the segment (length $M_2$) connecting the second articulation 20 and the third articulation 16.

Assuming that the angle formed between the segment $S_{b2}$ and the segment $M_2$ is A and the angle formed between the segment $S_{b2}$ and the segment $S_1$ is B, $V_{bs1}$ and $V_{bs2}$ are expressed by:

$$V_{bs1} = \frac{\sin(A)}{\sin(A+B)}V_{b2} \tag{3}$$

$$V_{bs2} = \frac{\sin(B)}{\sin(A+B)}V_{b2} \tag{4}$$

From these components, an angular speed command $\omega_{b1}$ for the first arm 3 and an angular speed command $\omega_{b2}$ for the second arm 4 can be determined as follows.

Note that the angular speed command $\omega_{b1}$ for the first arm 3 is assumed to be positive in the rising direction, and the angular speed command $\omega_{b2}$ for the second arm 4 is assumed to be positive in the dumping direction.

$$\omega_{b1} = \frac{V_{bs1}}{S_1} \tag{5}$$

$$\omega_{b2} = \frac{V_{bs2}}{M_2} \tag{6}$$

Here, because of the angle B=0 and $S_1=S_{b2}$ in an embodiment which employs the virtual first arm 13A having the virtual first articulation 19 aligned with the actual first articulation 15, the speeds $V_{bs1}$ and $V_{bS2}$ are given by:

$$V_{bs1} = \frac{\sin(A)}{\sin(A+0)}V_{b2} = V_{b2} \tag{3'}$$

$$V_{bs2} = \frac{\sin(0)}{\sin(A+0)}V_{b2} = 0 \tag{4'}$$

Accordingly, the angular speed commands $\omega_{b1}$ and $\omega_{b2}$ are given by:

$$\omega_{b1} = \frac{V_{bs1}}{S_1} = \frac{V_{bs2}}{S_{b2}} = \omega_{br} \tag{5'}$$

$$\omega_{b2} = \frac{V_{bs2}}{M_2} = 0 \tag{6'}$$

(A2-2) An angular speed command $\omega_{b3}$ for the third arm 5 is then determined. The speed $V_{b1}$ to be applied to the bucket articulation 17 is a value on an absolute coordinate system (i.e., a coordinate system with the origin set to the first articulation 15), and includes the speed $V_{b2}$ at the third articulation 16. Therefore, the speed $V_{b1}$ is decomposed to the speed $V_{b2}$ and a component $V_{br}$ in the direction vertical to the segment (length $M_3$) connecting the third articulation 16 and the bucket articulation 17.

Assuming that the angle formed between the segment $S_{b1}$ and the segment $S_{b2}$ is C and the angle formed between the segment $S_{b1}$ and the segment $M_3$ is D, the following relationships are obtained:

$$V_{br} = \frac{\sin(C)}{\sin(C+D)}V_{b1} \tag{7}$$

$$V_{b2} = \frac{\sin(D)}{\sin(C+D)}V_{b1} \tag{7a}$$

Thus, the speed $V_{br}$ can be determined.

Further, from the above relationships and the following formula held on a triangle formed by the three segments $S_{b1}$, $S_{b2}$ and $M_3$;

$$\frac{\sin(C)}{M_3} = \frac{\sin(D)}{S_{b2}} \tag{7b}$$

the speed $V_{br}$ can be determined below:

$$V_{br} = \frac{\sin(C)}{\sin(D)} V_{b2} = \frac{M_3}{S_{b2}} S_{b2}\omega_{br} = M_3\omega_{br} \tag{8}$$

By using the above speed $V_{br}$, the angular speed $\omega_{b3r}$ of the third arm 5 about the third articulation 16 is given by:

$$\omega_{b3r} = \frac{V_{br}}{M_3} = \omega_{br} \tag{9}$$

Namely, it is understood that since the third arm 5 is also rotated at the command angular speed $\omega_{br}$ applied to the virtual first arm 13, the command angular speed $\omega_{br}$ is eventually provided, as it is, as the angular speed $\omega_{b3r}$ of the third arm 5 about the third articulation 16.

However, the angular speed $\omega_{b3r}$ means the rotational angular speed of the third arm 5 about the third articulation 16 on the absolute coordinate system. To determine an angular speed command $\omega_{b3}$ for driving the third arm 5, therefore, it is required to take the rotational angular speed of the second arm 4 about the third articulation 16 into consideration. Because the rotational angular speed of the second arm 4 about the third articulation 16 is expressed by $\omega_{b1}+\omega_{b2}$ using the angular speed commands $\omega_{b1}$ and $\omega_{b2}$ determined above, the angular speed command $\omega_{b3}$ for the third arm 5 is given by;

$$\omega_{b3}=\omega_{b3r}-(\omega_{b1}+\omega_{b2})=\omega_{br}-(\omega_{b1}+\omega_{b2}) \tag{10}$$

on an assumption that the dumping direction is positive.

Here, because of $\omega_{b1}=\omega_{br}$ and $\omega_{b2}=0$ in the embodiment which employs the virtual first arm 13A having the virtual first articulation 19 aligned with the actual first articulation 15, there holds:

$$\omega_{b3}=0 \tag{10'}$$

In other words, when the virtual first arm 13 is operated by only the control lever 11*a*, the command angular speed $\omega_{br}$ applied to the virtual first arm 13 can be set, as it is, to the angular speed command $\omega_{b1}$ the first arm 3.

(B) Case of Operating Virtual Second Arm by Control Lever 12*a*

Figure 6:
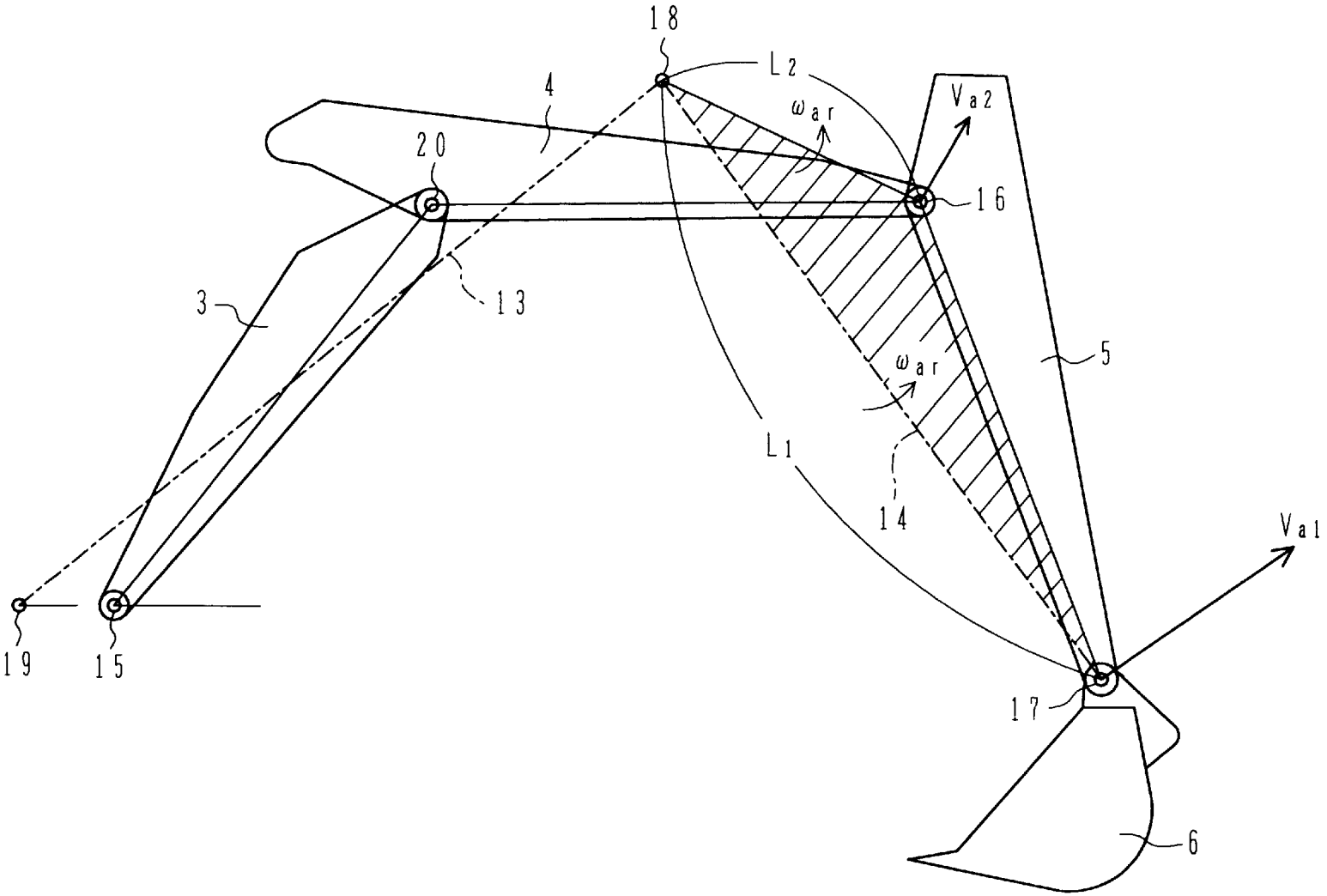
FIG. 6 is a representation for explaining the operating principle of the operation control system for the 3-articulation type excavator according to one embodiment of the present invention.

(B1) Assuming, in FIG. 6, that a command angular speed in the pushing-out direction applied to the virtual second arm 14 by the operation signal from the control lever 12*a* is $\omega_{ar}$, a speed $V_{a1}$ at which the bucket articulation 17 is to be moved is given by a value of;

$$V_{a1}=L_1\times\omega_{ar} \tag{11}$$

in the direction vertical to the segment (length $L_1$) connecting the virtual second articulation 18 and the bucket articulation 17.

Also, because the virtual second arm 14 and the actual third arm 5 are moved as if they constitute a rigid body together (see a hatched area in FIG. 6), a speed $V_{b2}$ at which the third articulation 16 is to be moved is given by a value of;

$$V_{a2}=L_2\times\omega_{ar} \tag{12}$$

in the direction vertical to the segment (length $L_2$) connecting the virtual second articulation 16 and the third articulation 16.

(B2) The rotational angular speed about the first articulation 15 and the rotational angular speed about the second articulation 20, which are required to give the third articulation 16 the speed $V_{a2}$, are first studied.

Figure 7:
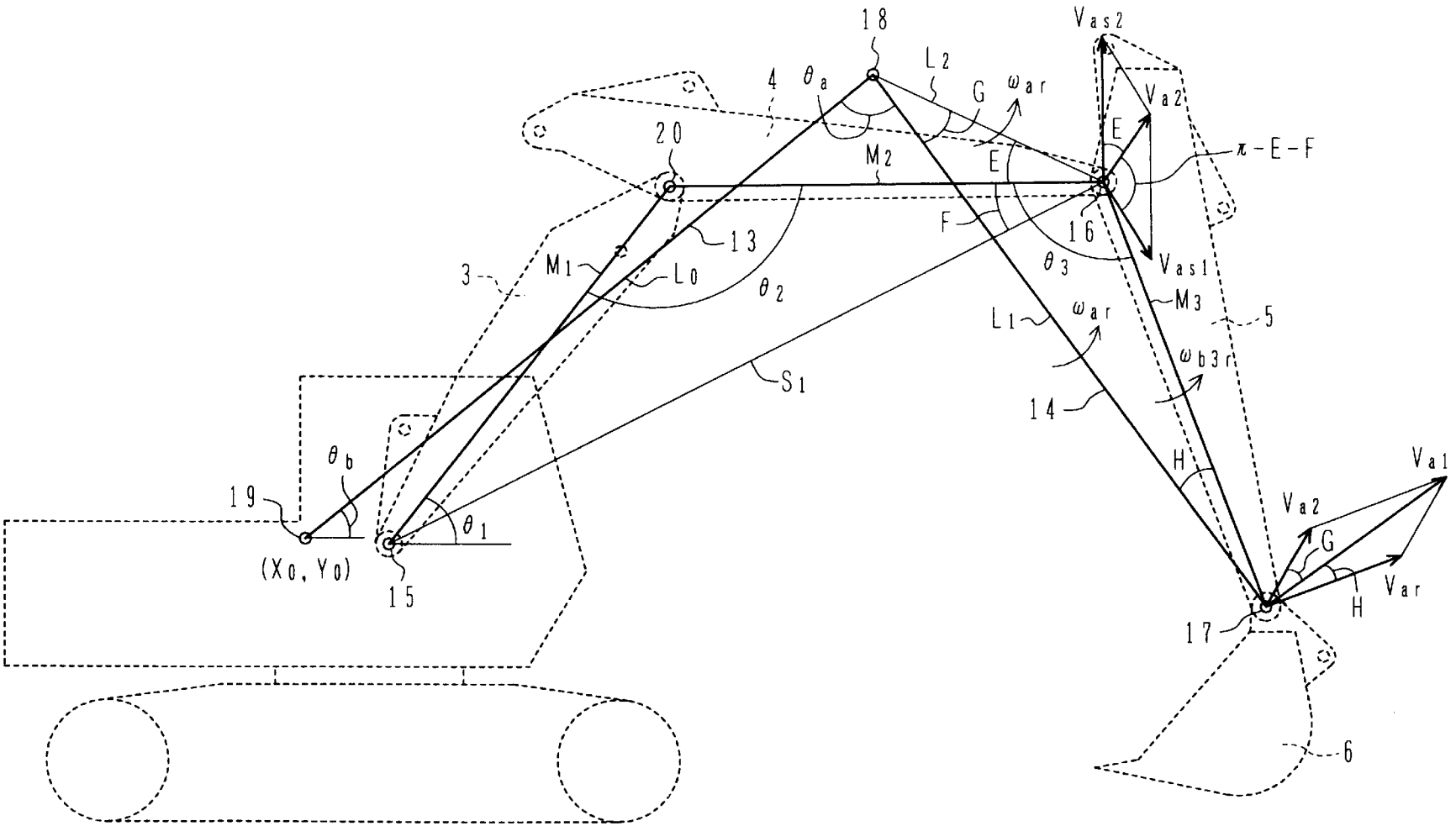
FIG. 7 is a representation for explaining the operating principle of the operation control system for the 3-articulation type excavator according to one embodiment of the present invention.

(B2-1) In FIG. 7, the target speed $V_{a2}$ is decomposed to a component $V_{as1}$ in the direction vertical to the segment (length $S_1$) connecting the first articulation 15 and the third articulation 16, and a component $V_{as2}$ in the direction vertical to the segment (length $M_2$) connecting the second articulation 20 and the third articulation 16.

Assuming that the angle formed between the segment $L_2$ and the segment $M_2$ is E and the angle formed between the segment $M_2$ and the segment $S_1$ is F, $V_{sa1}$ and $V_{as2}$ are expressed by:

$$V_{as1} = \frac{\sin(E)}{\sin(\pi - F)} V_{a2} = \frac{\sin(E)}{\sin(F)} V_{a2} \tag{13}$$

$$V_{as2} = \frac{\sin(\pi - E - F)}{\sin(\pi - F)} V_{a2} = \frac{\sin(E + F)}{\sin(F)} V_{a2} \tag{14}$$

From these components, an angular speed command $\omega_{a1}$ for the first arm 3 and an angular speed command $\omega_{a2}$ for the second arm 4 can be determined as follows.

Note that the angular speed command $\omega_{a1}$ for the first arm 3 is assumed to be positive in the rising direction, and the angular speed command $\omega_{a2}$ for the second arm 4 is assumed to be positive in the dumping direction.

$$\omega_{a1} = -\frac{V_{as1}}{S_1} \tag{15}$$

$$\omega_{a2} = \frac{V_{as2}}{M_2} \tag{16}$$

(B2—2) An angular speed command ( for the third arm 5 is then determined. The speed $V_{a1}$ to be applied to the bucket articulation 17 is a value on the absolute coordinate system (i.e., the coordinate system with the origin set to the first articulation 15), and includes the speed $V_{a2}$ at the third articulation 16. Therefore, the speed $V_{a1}$ is decomposed to the speed $V_{a2}$ and a component $V_{ar}$ in the direction vertical to the segment (length $M_3$) connecting the third articulation 16 and the bucket articulation 17.

Assuming that the angle formed between the segment $L_2$ and the segment $L_1$ is G and the angle formed between the segment $L_1$ and the segment $M_3$ is H, the following relationships are obtained:

$$V_{ar} = \frac{\sin(G)}{\sin(G + H)} V_{a1} \tag{17}$$

$$V_{a2} = \frac{\sin(H)}{\sin(G + H)} V_{a1} \tag{17a}$$

Thus, the speed $V_{ar}$ can be determined.

Further, from the above relationships and the following formula held on a triangle formed by the three segments $L_1$, $L_2$ and $M_3$;

$$\frac{\sin(G)}{M_3} = \frac{\sin(H)}{L_2} \tag{17b}$$

the speed $V_{ar}$ can be determined below:

$$V_{ar} = \frac{\sin(G)}{\sin(H)} V_{a2} = \frac{M_3}{L_2} L_2 \omega_{ar} = M_3 \omega_{ar} \tag{18}$$

By using the above speed $V_{ar}$, the angular speed $\omega_{a3r}$ of the third arm 5 about the third articulation 16 is given by:

$$\omega_{a3r} = \frac{V_{ar}}{M_3} = \omega_{ar} \tag{19}$$

Namely, it is understood that since the third arm 5 is also rotated at the command angular speed $\omega_{ar}$ applied to the virtual second arm 14, the command angular speed $\omega_{ar}$ is eventually provided, as it is, as the angular speed $\omega_{a3r}$ of the third arm 5 about the third articulation 16.

However, the angular speed $\omega_{a3r}$ means the rotational angular speed of the third arm 5 about the third articulation 16 on the absolute coordinate system. To determine an angular speed command $\omega_{a3}$ for driving the third arm 5, therefore, it is required to take the rotational angular speed of the second arm 4 about the third articulation 16 into consideration. Because the rotational angular speed of the second arm 4 about the third articulation 16 is expressed by $\omega_{a1}+\omega_{a2}$ using the angular speed commands $\omega_{a1}$ and $\omega_{a2}$ determined above, the angular speed command $\omega_{a3}$ for the third arm 5 is given by;

$$\omega_{a3}=\omega_{a3r}-(\omega_{a1}+\omega_{a2})=\omega_{ar}-(\omega_{a1}+\omega_{a2}) \tag{20}$$

on an assumption that the dumping direction is positive.

(C) Angular Speed Command Values for Arms

Since angular speed command values $\omega_1$, $\omega_2$, $\omega_3$ for the arms 3, 4, 5 are given respectively by adding the angular speed commands $\omega_{b1}$, $\omega_{b2}$, $\omega_{b3}$ provided when the virtual first arm 13 is operated and the angular speed commands $\omega_{a1}$, $\omega_{a2}$, $\omega_{a3}$ provided when the virtual second arm 14 is operated, there hold the relationships below:

$$\omega_1=\omega_{b1}+\omega_{a1}$$

$$\omega_2=\omega_{b2}+\omega_{a2}$$

$$\omega_3=\omega_{b3}+\omega_{a3}=\omega_{br}+\omega_{ar}-(\omega_{b1}+\omega_{b2}+\omega_{a1}+\omega_{a2}) \tag{21}$$

Here, because of $\omega_{b1}=\omega_{br}$, $\omega_{b2}=0$ and $\omega_{b3}=0$ in the embodiment which employs the virtual first arm 13A having the virtual first articulation 19 aligned with the actual first articulation 15, there hold:

$$\omega_1=\omega_{br}+\omega_{a1}$$

$$\omega_2=\omega_{a2}$$

$$\omega_3=\omega_{a3}=\omega_{ar}-(\omega_{a1}+\omega_{a2}) \tag{21'}$$

Once the angular speed commands $\omega_1$, $\omega_2$, $\omega_3$ are determined as described above, it is then just required to operate a first arm cylinder 7, a second arm cylinder 8 and a third arm cylinder 9 to extend or contract so that the first arm 3 is rotated at the angular speed $\omega_1$, the second arm 4 is rotated at the angular speed $\omega_2$, and the third arm 5 is rotated at the angular speed $\omega_3$.

As a result, the 3-articulation type work front 2 comprising the first arm 3, the second arm 4 and the third arm 5 can be continuously operated by using the two control levers 11*a,* 12*a,* which are similar to those employed in excavators provided with conventional 2-articulation type work fronts, without making the operator feel awkward in the operation. In particular, when the operator carries out works while mainly looking at the bucket 6 and thereabout, operators having an ordinary skill can operate the 3-articulation type work front with a similar operating feeling as obtained with the conventional 2-articulation type work fronts.

Further, in this embodiment, with the base end (virtual first articulation) 19 of the virtual first arm 13 set to a position rearwardly of the base end (first articulation) 15 of the actual first arm 3, when the bucket 6 is pulled horizontally toward the body 99, any of the first arm cylinder 7, the second arm cylinder 8 and the third arm cylinder 9 can be operated to extend and contract by fully utilizing effective strokes of the cylinders without reaching the stroke ends, allowing the bucket 6 to be moved to a position closer to the body 99. In leveling work, therefore, the bucket 6 can be moved to a position closer to the body 99 and a larger working area can be covered.

In addition, since the length $L_0$ of the virtual first arm 13 and the length $L_1$ of the virtual second arm 14 are set to be longer than those of an ordinary 2-articulation type excavator, the virtual second arm 14 can be held in a posture closer to the vertical posture when the bucket 6 is positioned nearby the body 99. As a result, the actual third arm 5 can also be held in a posture closer to the vertical posture, and hence more satisfactory operability can be achieved.

Figure 8:
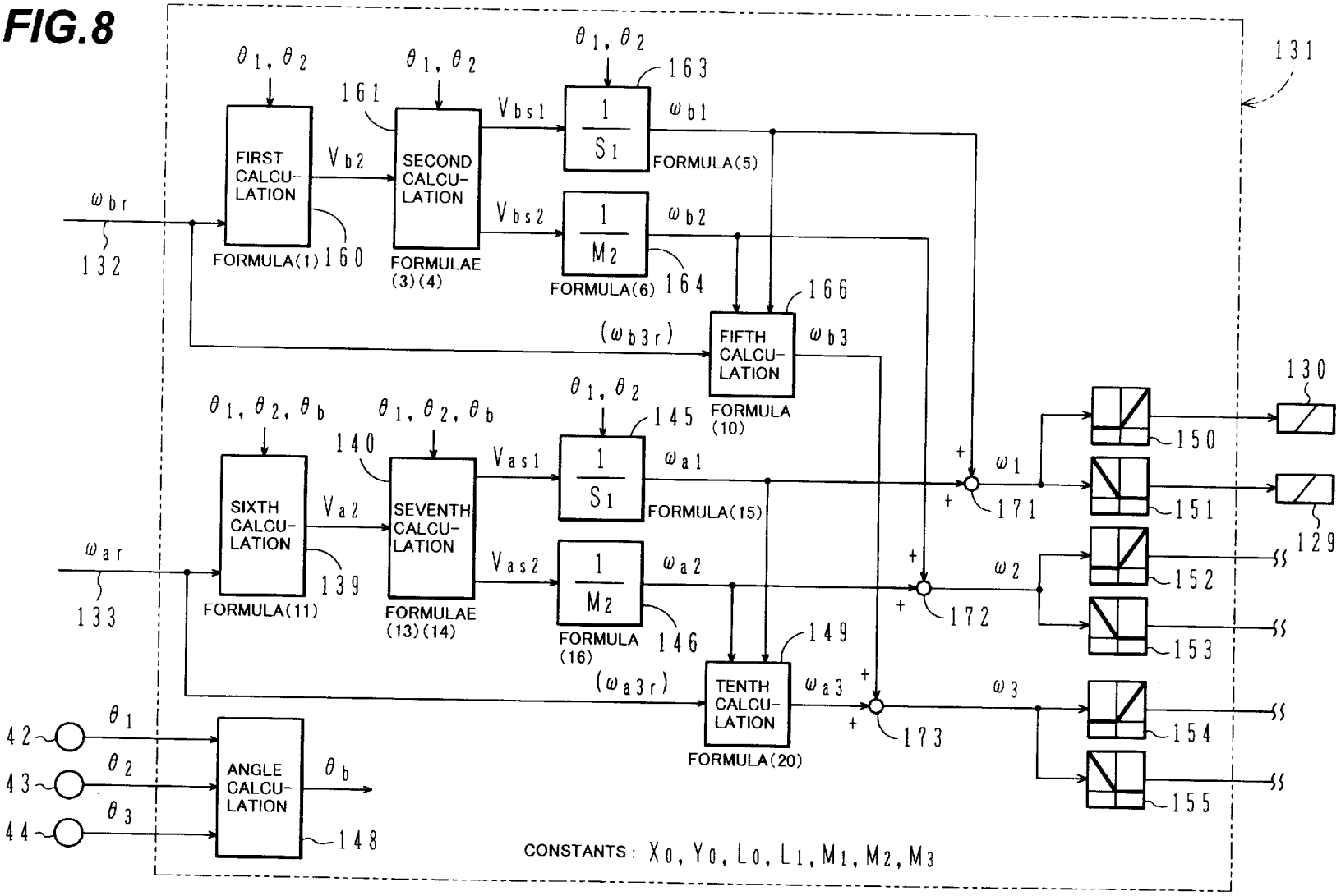
FIG. 8 is a block diagram showing functions of a controller of the operation control system for the 3-articulation type excavator according to the first embodiment of the present invention.

FIG. 8 shows the algorithm processed by a controller 131 for realizing the operation described above.

The controller 131 stores therein the length $M_1$ of the first arm 3, the length $M_2$ of the second arm 4, the length $M_2$ of the third arm 5, the length $L_0$ of the virtual first arm 3, the length $L_1$ of the virtual second arm 14, and position information ($X_0$, $Y_0$) of the base end (virtual first articulation) 19 of the virtual first arm 13 in advance.

Then, a virtual first arm signal 132 for commanding the angular speed $\omega_{br}$ of the virtual first arm 13 and a virtual second arm signal 133 for commanding the angular speed $\omega_{ar}$ of the virtual second arm 14 are both input to the controller 131.

A description will be first made of processing for the virtual first arm signal 132. The virtual first arm signal 132 ($\omega_{br}$) is input to a first calculation block 160 in which calculation of the above formula (2) is executed to obtain the target speed $V_{b2}$ of the third articulation 16. Because the calculation in the block 160 employs the length $S_{b2}$ of the segment connecting the virtual first articulation 19 and the third articulation 16, it is required to calculate the length $S_{b2}$. For calculating the length $S_{b2}$, there are necessary both position information of the third articulation 16 that varies moment by moment, and position information of the base end (virtual first articulation) 19 of the virtual first arm 13. The rotational angle $\theta_1$ of the first arm 3 and the rotational angle $\theta_2$ of the second arm 4 are in turn required to derive the position information of the third articulation 16. For this reason, the angle sensors 142, 143 are provided as mentioned before, and the rotational angle $\theta_1$ of the first arm 3 and the rotational angle $\theta_2$ of the second arm 4 are also input to the first calculation block 160. The length $M_1$ of the first arm 3 and the length $M_2$ of the second arm 4 are further required to derive the position information of the third articulation 16, while the position information ($X_0$, $Y_0$) of the base end (virtual first articulation) 19 of the virtual first arm 13 is required to derive the position information of the base end (virtual first articulation) 19 thereof. Those data is provided by the values previously stored in the controller 131 as described above.

The target speed $V_{b2}$ of the third articulation 16 calculated in the first calculation block 160 is input to a second calculation block 161 which calculates the component $V_{bs1}$ of the target speed $V_{b2}$ in the direction vertical to the segment (length $S_1$) connecting the first articulation 15 and the third articulation 16, and the component $V_{bS2}$ thereof in the direction vertical to the segment (length $M_2$) connecting the second articulation 20 and the third articulation 16 based on the above formulae (3) and (4), respectively. Because the calculation in the block 161 employs the angle A formed between the segment $S_{b2}$ and the segment $M_2$ and the angle B formed between the segment $S_{b2}$ and the segment $S_1$, it is required to calculate the angles A and B. For calculating the angles A and B, there are necessary position information of the third articulation 16 and position information of the second articulation 20 that vary moment by moment, and position information of the base end (virtual first articulation) 19 of the virtual first arm 13. The position information of the third articulation 16 has been described above. The rotational angle $\theta_1$ of the first arm 3 and the length $M_1$ of the first arm 3 are in turn required to derive the position information of the second articulation 20. Accordingly, as with the first calculation block 160, the rotational angle $\theta_1$ of the first arm 3 and the rotational angle $\theta_2$ of the second arm 4 are also input to the second calculation block 161. The length $M_1$ of the first arm 3, the length $M_2$ of the second arm 4, and the position information ($X_0$, $Y_0$) of the base end (virtual first articulation) 19 of the virtual first arm 13 are provided by the values previously stored in the controller 131.

The speed components $V_{bs1}$ and $V_{bs2}$ calculated in the second calculation block 161 are input to third and fourth calculation blocks 163 and 164 which calculate the angular speed command $\omega_{b1}$ for the first arm 3 and the angular speed command $\omega_{b2}$ for the second arm 4 based on the above formulae (5) and (6), respectively. Because the calculation in the block 163 employs the length $S_1$ of the segment connecting the first articulation 15 and the third articulation 16, it is required to calculate the length $S_1$. For calculating the length $S_1$, there is necessary the position information of the third articulation 16. Accordingly, the rotational angle $\theta_1$ of the first arm 3 and the rotational angle $\theta_2$ of the second arm 4 are also input to the third calculation block 163. The length $M_1$ of the first arm 3 and the length $M_2$ of the second arm 4 are provided by the values previously stored in the controller 131. Additionally, the length $M_2$ of the second arm 4 used for calculation in the fourth calculation block 164 is provided by the value previously stored in the controller 131.

The angular speed command $\omega_{b1}$ for the first arm 3 and the angular speed command $\omega_{b2}$ for the second arm 4 calculated in the third and fourth calculation blocks 163 and 164 are both input, along with the virtual first arm signal 132 ($\omega_{br}$), to a fifth calculation block 166 which calculates the angular speed command $\omega_{b3}$ for the third arm 5 based on the above formula (10). Here, as described in connection with the above formula (9), the command angular speed $\omega_{br}$ in accordance with the virtual first arm signal 132 is used as the rotational angular speed $\omega_{b3r}$ of the third arm 5 about the i third articulation 16 on the absolute coordinate system with the origin set to the first articulation 15.

A description will be next made of processing for the virtual second arm signal 133. The virtual second arm signal 133 ($\omega_{ar}$) is input to a sixth calculation block 139 in which calculation of the above formula (12) is executed to obtain the target speed $V_{a2}$ of the third articulation 16. Because the calculation in the block 139 employs the length $L_2$ of the segment connecting the virtual second articulation 18 and the third articulation 16, it is required to calculate the length $L_2$. For calculating the length $L_2$, there are necessary both position information of the third articulation 16 that varies moment by moment, and position information of the base end (virtual second articulation) 18 of the virtual second arm 14. As mentioned above, the rotational angle $\theta_1$ of the first arm 3, the rotational angle $\theta_2$ of the second arm 4, the length $M_1$ of the first arm 3 and the length $M_2$ of the second arm 4 are required to derive the position information of the third articulation 16. On the other hand, the rotational angle $\theta_b$ of the virtual first arm 13, the length $L_0$ of the virtual first arm 13, and the position information ($X_0$, $Y_0$) of the base end (virtual first articulation) 19 of the virtual first arm 13 is required to derive the position information of the base end (virtual second articulation) 18 of the virtual second arm 14. As with the first calculation block 160, therefore, the rotational angle $\theta_1$ of the first arm 3 and the rotational angle $\theta_2$ of the second arm 4 are also input to the sixth calculation block 139. The length $M_1$ of the first arm 3, the length $M_2$ of the second arm 4, and the position information ($X_0$, $Y_0$) of the base end (virtual first articulation) 19 of the virtual first arm 13 are provided by the values previously stored in the controller 131. Additionally, the rotational angle $\theta_b$ of the virtual first arm 13 is further input to the sixth calculation block 139, and the length $L_0$ of the virtual first arm 13 is provided by the value previously stored in the controller 131.

The rotational angle $\theta_b$ of the virtual first arm 13 is calculated in an angle calculation block 148. In calculation of the block 148, given the rotational angle $\theta_b$ of the virtual first arm 13 and the rotational angle $\theta_a$ of the virtual second arm 14 being unknown values, the rotational angles $\theta_b$ and $\theta_a$ are determined by setting simultaneous equations based on the relationship that the fore end (fourth articulation) 17 of the third arm 5 and the fore end of the virtual second arm 14 are fixed in relative position, i.e., that positions of both the fore ends are aligned with each other. The rotational angle $\theta_1$ of the first arm 3, the rotational angle $\theta_2$ of the second arm 4, the rotational angle $\theta_3$ of the third arm 5, the length $M_1$ of the first arm 3, the length $M_2$ of the second arm 4, and the length $M_3$ of the third arm 5 are required to derive position information of the fore end (fourth articulation) 17 at the fore end of the third arm 5. The rotational angles $\theta_b$, $\theta_a$ as unknown values, the length $L_0$ of the virtual first arm 13, the length $L_1$ of the virtual second arm 14, and the position information ($X_0$, $Y_0$) of the base end (virtual first articulation) 19 of the virtual first arm 13 are required to derive position information of the fore end (fourth articulation at the fore end of the third arm 5) 17 at the fore end of the virtual second arm 14. For this reason, the angle sensors 142, 143, 144 are provided as mentioned before, and the rotational angle $\theta_1$ of the first arm 3, the rotational angle $\theta_2$ of the second arm 4 and the rotational angle $\theta_3$ of the third arm 5 are input to the angle calculation block 148. The length $M_1$ of the first arm 3, the length $M_2$ of the second arm 4, the length $M_3$ of the third arm 5, the length $L_0$ of the virtual first arm 13, the length $L_1$ of the virtual second arm 14, and the position information ($X_0$, $Y_0$) of the base end (virtual first articulation) 19 of the virtual first arm 13 are provided by the values previously stored in the controller 131.

The target speed $V_{a2}$ of the third articulation 16 calculated in the sixth calculation block 139 is input to a seventh calculation block 140 which calculates the component $V_{as1}$ of the target speed $V_{a2}$ in the direction vertical to the segment (length $S_1$) connecting the first articulation 15 and the third articulation 16, and the component $V_{as2}$ thereof in the direction vertical to the segment (length $M_2$) connecting the second articulation 20 and the third articulation 16 based on the above formulae (13) and (14), respectively. Because the calculation in the block 139 employs the angle E formed between the segment $L_2$ and the segment $M_2$ and the angle F formed between the segment $M_2$ and the segment $S_1$, it is required to calculate the angles E and F. For calculating the angles E and F, there are necessary position information of the third articulation 16, position information of the second articulation 20, and position information of the base end (virtual second articulation) 18 of the virtual second arm 14. Accordingly, as with the sixth calculation block 139, the rotational angle $\theta_1$ of the first arm 3, the rotational angle $\theta_2$ of the second arm 4 and the rotational angle $\theta_b$ of the virtual first arm 13 are also input to the seventh calculation block 140. The length $M_1$ of the first arm 3, the length $M_2$ of the second arm 4, the length $L_0$ of the virtual first arm 13, and the position information ($X_0$, $Y_0$) of the base end (virtual first articulation) 19 of the virtual first arm 13 are provided by the values previously stored in the controller 131.

The speed components $V_{as1}$ and $V_{as2}$ calculated in the seventh calculation block 140 are input to eighth and ninth calculation blocks 145 and 146 which calculate the angular speed command $\omega_{a1}$ for the first arm 3 and the angular speed command $\omega_{a2}$ for the second arm 4 based on the above formulae (15) and (16), respectively. The calculation in the block 145 employs the length $S_1$ of the segment connecting the first articulation 15 and the third articulation 16. As with the third calculation block 163, therefore, the rotational angle $\theta_1$ of the first arm 3 and the rotational angle $\theta_2$ of the second arm 4, which are detected respectively by the angle sensors 142 and 143, are also input to the eighth calculation block 145. The length $M_1$ of the first arm 3 and the length $M_2$ of the second arm 4 are provided by the values previously stored in the controller 131. Additionally, as with the fourth calculation block 164, the length $M_2$ of the second arm 4 used for calculation in the ninth calculation block 146 is provided by the value previously stored in the controller 131.

The angular speed command $\omega_{a1}$ for the first arm 3 and the angular speed command $\omega_{a2}$ for the second arm 4 calculated in the eighth and ninth calculation blocks 145 and 146 are both input, along with the virtual second arm signal 133 ($\omega_{ar}$), to a tenth calculation block 149 which calculates the angular speed command $\omega_{a3}$ for the third arm 5 based on the above formula (20). Here, as described in connection with the above formula (19), the command angular speed $\omega_{ar}$ in accordance with the virtual second arm signal 133 is used as the rotational angular speed $\omega_{a3r}$ of the third arm 5 about the third articulation 16 on the absolute coordinate system with the origin set to the first articulation 15.

The angular speed command $\omega_{b1}$ for the first arm 3, the angular speed command $\omega_{b2}$ for the second arm 4, and the angular speed command $\omega_{b3}$ for the third arm 5 which are thus calculated in accordance with the virtual first arm signal 132, are added to the angular speed command $\omega_{a1}$ for the first arm 3, the angular speed command $\omega_{a2}$ for the second arm 4, and the angular speed command $\omega_{a3}$ for the third arm 5 which are thus calculated in accordance with the virtual second arm signal 14, respectively, in adders 171, 172 and 173 based on the above formula (21), thereby providing the angular speed command values $\omega_1$, $\omega_2$ and $\omega_3$ for the arms 3, 4 and 5. These command values $\omega_1$, $\omega_2$ and $\omega_3$ are input to saturation functions 150, 151, 152, 153, 154 and 155 for outputting respective driving command signals (electrical signals) depending on whether the input values are positive or negative. Specifically, when the command values $\omega_1$ is positive, a driving command signal (electrical signal) corresponding to $\omega_1$ is output from the saturation function 150 to a proportional pressure reducing valve 130. When it is negative, a driving command signal (electrical signal) corresponding to $\omega_1$ is output from the saturation function 151 to a proportional pressure reducing valve 129. Processing for the command values $\omega_1$, $\omega_2$ is also executed likewise.

With this embodiment described above, operators having an ordinary skill can operate the 3-articulation type work front 2 comprising the first arm 3, the second arm 4 and the third arm 5 by using the two control levers 11*a,* 12*a,* which are similar to those employed in excavators provided with conventional 2-articulation type work fronts, with a similar operating feeling as obtained with the conventional 2-articulation type work fronts. Further, the 3-articulation type excavator can be continuously operated over a large working area, which is the advantageous feature of the 3-articulation type work front, with a similar operating feeling as obtained with the conventional 2-articulation type excavators.

Figure 9:
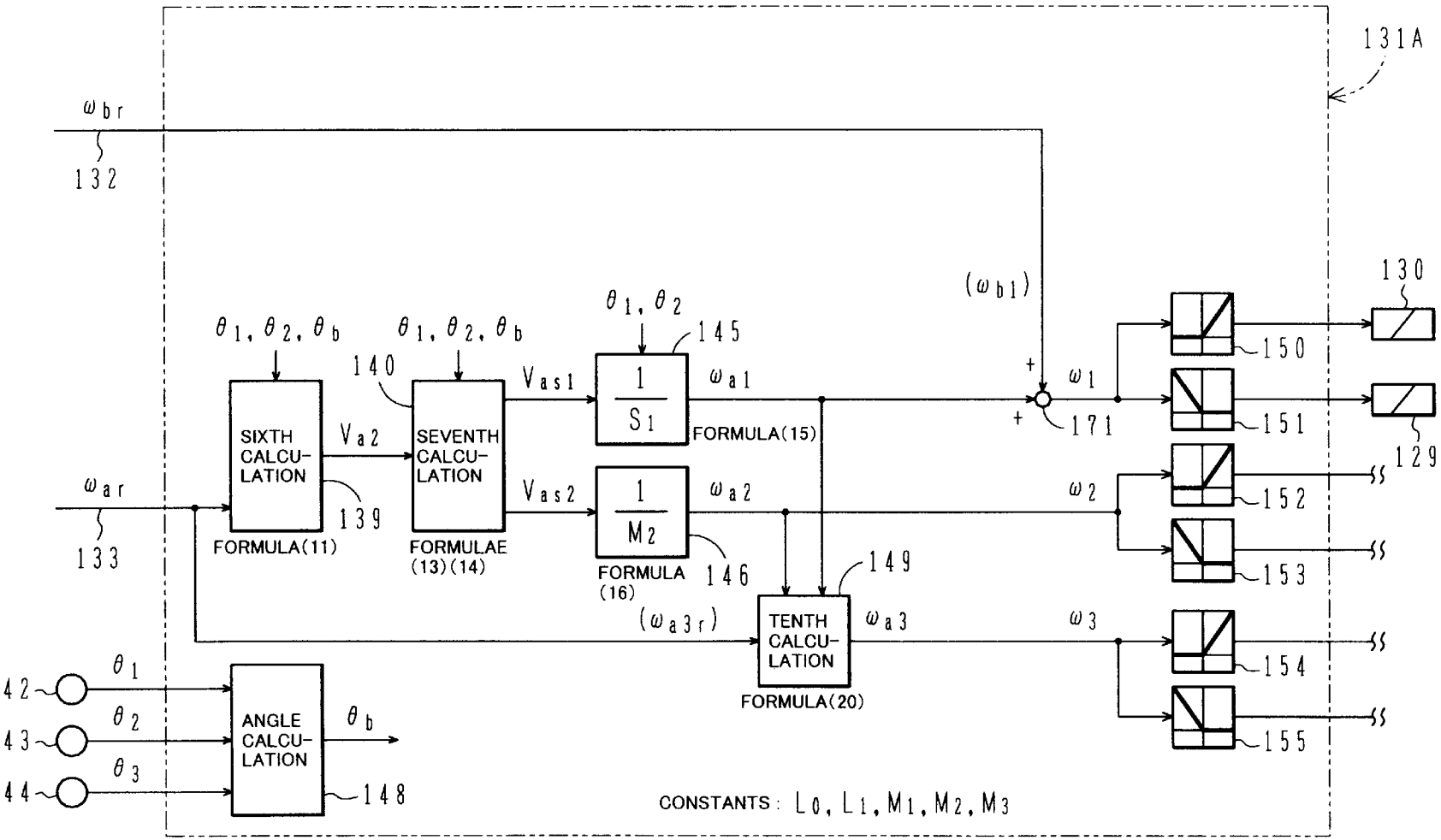
FIG. 9 is a block diagram showing functions of a controller of the operation control system for the 3-articulation type excavator according to a second embodiment of the present invention.

A second embodiment of the present invention will be described with reference to FIG. 9. In this embodiment, the virtual first arm 13A (see FIG. 1) having the virtual first articulation 19 aligned with the first articulation 15 of the first arm 3 is employed. In FIG. 9, equivalent components to those in FIG. 8 are denoted by the same reference numerals.

As described above, where the first articulation 19 of the virtual first arm 13A is aligned with the first articulation 15 of the actual first arm 3, the angular speed commands $\omega_{b1}$, $\omega_{b2}$ and $\omega_{b3}$ for the first, second and third arms 3, 4 and 5 in accordance with the virtual first arm signal 132 are provided as $\omega_{b1}=\omega_{br}$, $\omega_{b2}=0$ and $\omega_{b3}=0$ from the above formulae (5'), (6') and (10'), while the angular speed command values $\omega_1$, $\omega_2$ and $\omega_3$ for the first, second and third arms 3, 4 and 5 are provided as $\omega_1=\omega_{br}+\omega_{a1}$, $\omega_2=\omega_{a2}$ and $\omega_3=\omega_{ar}-(\omega_{a1}+\omega_{a2})$ from the above formula (21'). In this embodiment, therefore, the first calculation block 160 to the fifth calculation block 166 and the adders 172, 173 in FIG. 8 are not required. Then, as shown in FIG. 9, the command angular speed $\omega_{br}$ in accordance with the virtual first arm signal 132 is directly added in an adder 171 to the angular speed command $\omega_{a1}$ for the first arm 3 which has been determined in the eighth calculation block 145, thereby calculating the angular speed command value $\omega_1$ for the first arm. Further, the angular speed command $\omega_2$ for the second arm 4 and the angular speed command $\omega_3$ for the third arm 5, which are calculated by the ninth calculation block 146 and the tenth calculation block 149, are employed, as they are, as the angular speed command values $\omega_2$, $\omega_3$ for the second and third arms 4, 5, respectively.

With this embodiment, the amount of computation to be executed by a controller 131A can be reduced in comparison with that required in the first embodiment shown in FIG. 8. Consequently, it is possible to perform control with a good response within a limited capability and memory capacity of the controller 131A.

Figure 10:
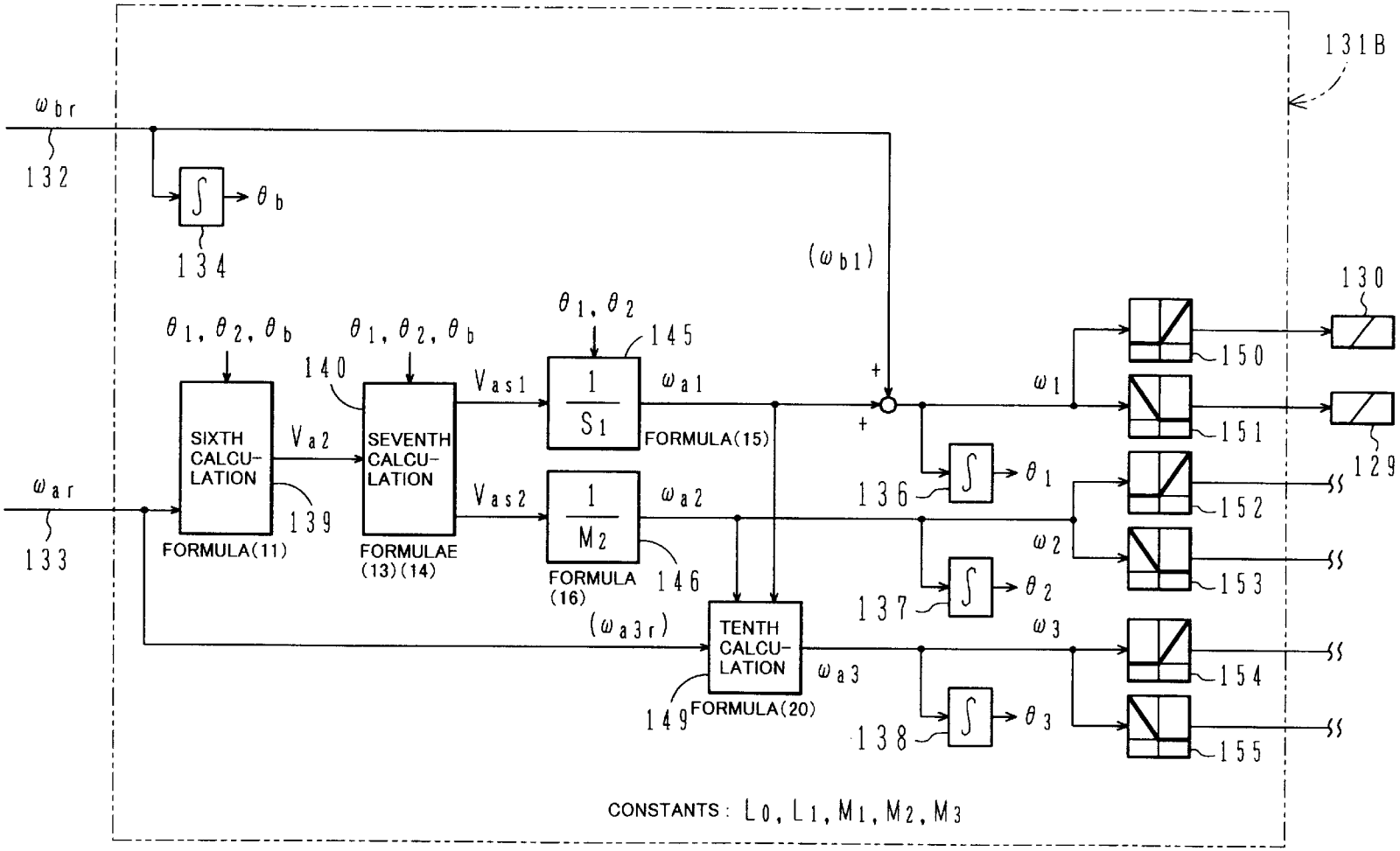
FIG. 10 is a block diagram showing functions of a controller of the operation control system for the 3-articulation type excavator according to a third embodiment of the present invention.
Figure 11:
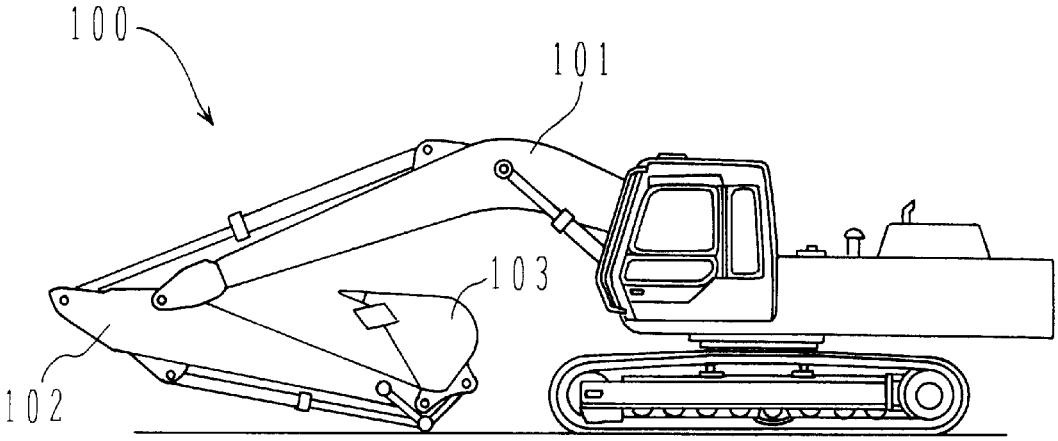
FIG. 11 is a view for explaining the structure of a conventional 2-articulation type excavator.
Figure 12:
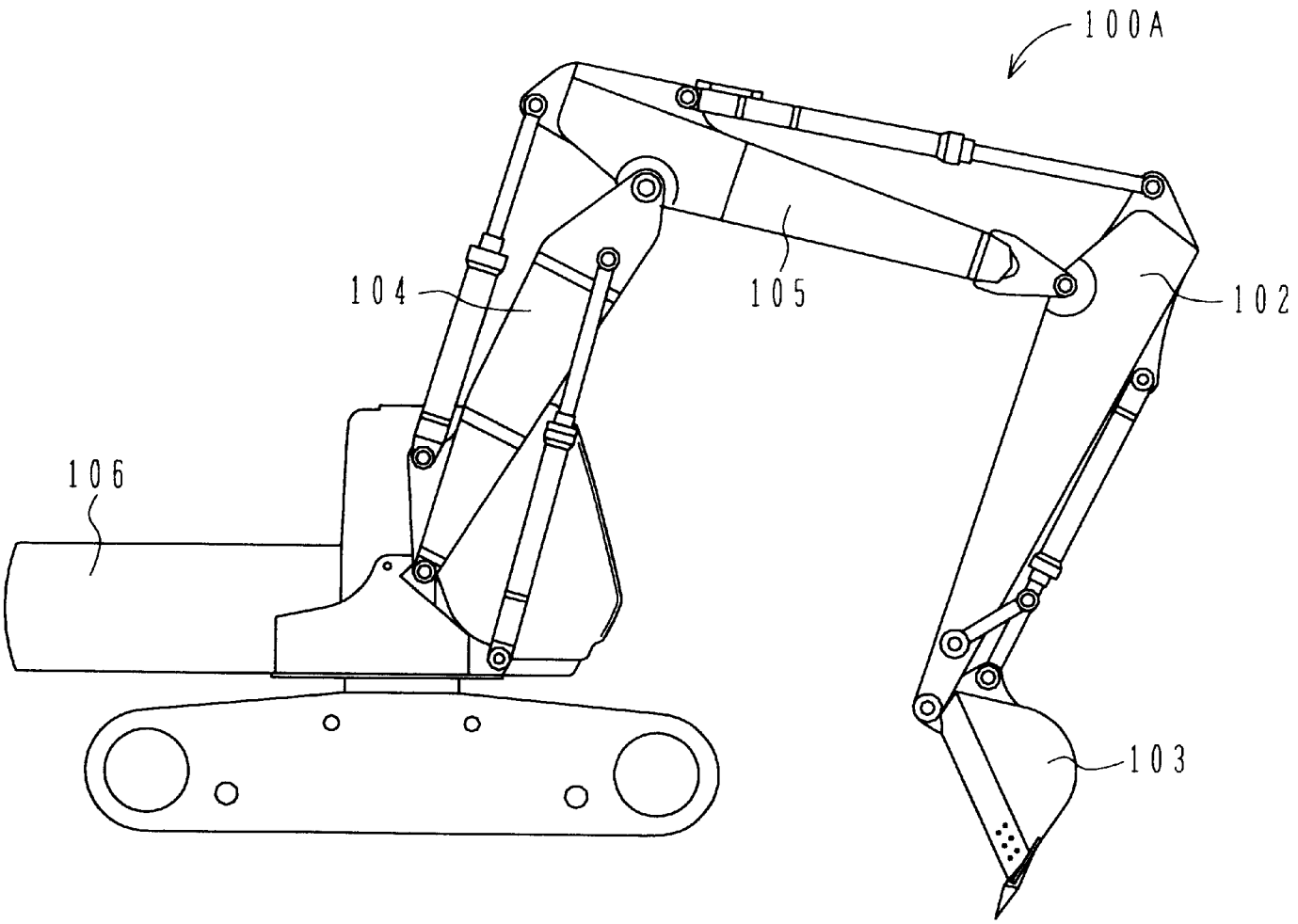
FIG. 12 is a view for explaining the structure of a two-piece boom type excavator as one example of conventional 3-articulation type excavators.
Figure 13:
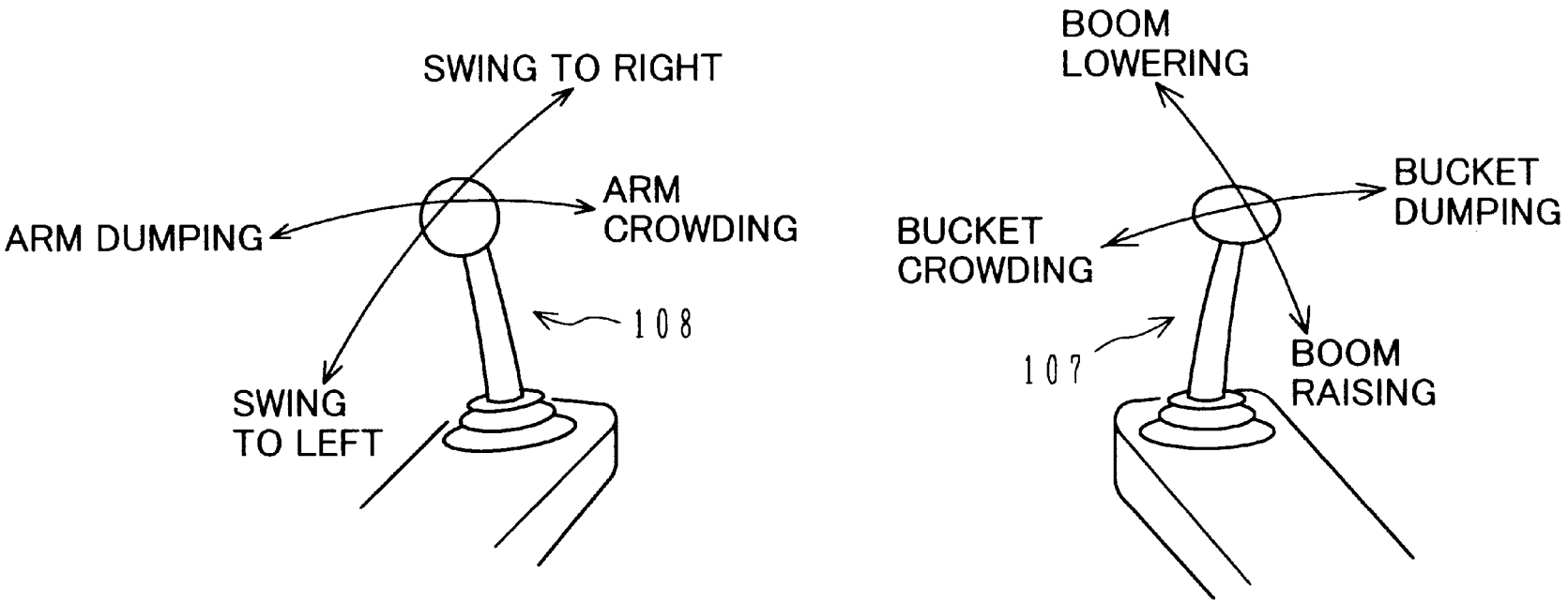
FIG. 13 is an illustration for explaining an operating system of the conventional 2-articulation type excavator.
Figure 14:
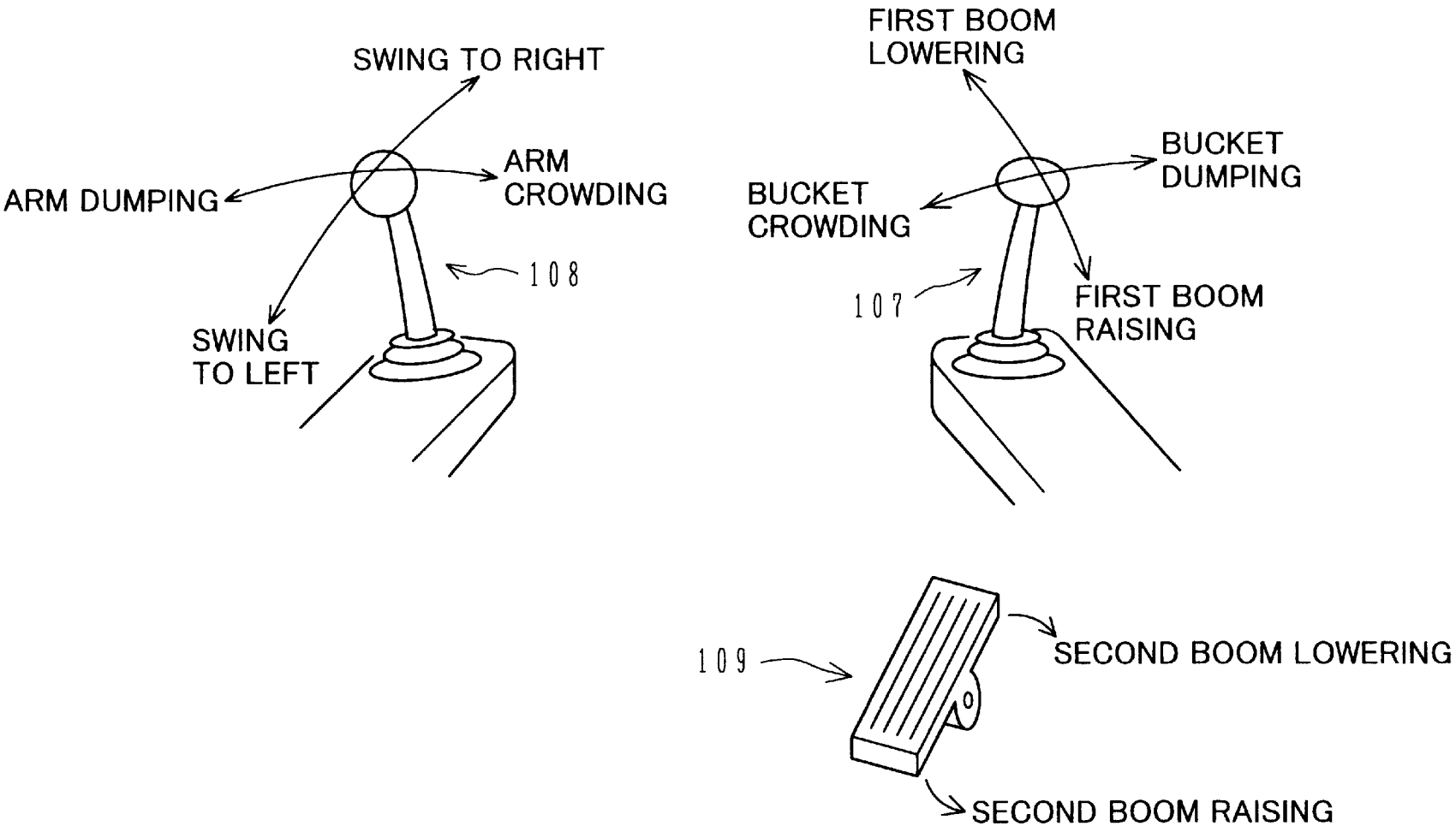
FIG. 14 is an illustration for explaining an operating system of the conventional two-piece boom type excavator.

A third embodiment of the present invention will be described with reference to FIG. 10. This embodiment is modified from the embodiment shown in FIG. 9 in that the rotational angle of each arm is obtained by integrating the rotational angular speed command value for each arm without using the angle sensor. In FIG. 10, equivalent components to those in FIGS. 8 and 9 are denoted by the same reference numerals.

The rotational angles $\theta_1$, $\theta_2$ and $\theta_3$ of the first arm 3, the second arm 4 and the third arm 5 correspond to values resulted from integrating the angular speed command values $\omega_1$, $\omega_2$ and $\omega_3$ for the first, second and third arms 3, 4 and 5, respectively, whereas the rotational angle $\theta_b$ of the virtual first arm 13 corresponds to a value resulted from integrating the command angular speed $\omega_{br}$ in accordance with the operation signal 132. With the above in mind, in this embodiment, integrators 134, 136, 137 and 138 are provided, as shown in FIG. 10, such that the angular speed command values $\omega_1$, $\omega_2$ and $\omega_3$ for the first, second and third arms 3, 4 and 5 are integrated by the integrators 134, 136 and 137 for conversion into the rotational angles $\theta_1$, $\theta_2$ and $\theta_3$, respectively, whereas the command angular speed $\omega_{br}$ in accordance with the operation signal 132 is integrated by the integrator 134 for conversion into the rotational angle $\theta_b$. These resulting rotational angles are employed the sixth to eighth calculation blocks 139, 140 and 145.

In the first and second embodiments using the angle sensors 142, 143 and 144, since the rotational angles $\theta_1$, $\theta_2$ and $\theta_3$ of the respective arms, that vary moment by moment, can be directly utilized without including errors in calculation, highly accurate control can be realized. On the other hand, in this third embodiment, although control accuracy is somewhat inferior, the necessity of using the angle sensors 142, 143 and 144 is eliminated and therefore the system can be constructed at a cost reduced correspondingly.

In the above embodiments, the angular speed commands for the respective arms are determined separately, and the angular speed command value for each arm is then determined by calculating the sum of the relevant angular speed commands. As an alternative, it is also possible to determine resultant speeds $V_1$, $V_2$ at the respective articulations and then to the angular speed commands for the respective arms.

Also, while the above embodiments include the calculation blocks 139, 140 for calculating the speeds at the respective articulations, these calculation blocks may be combined into one calculation block together because the calculations can be executed using one formula.

Further, while in the above embodiments the lengths $L_0$, $L_1$ of the first arm 13 and the virtual second arm 14 of the virtual 2-articulation type work front are set to be longer for enabling the work front to be operated over a larger working area, those lengths can be optionally set depending on the purposes. Also, where the virtual first articulation of the virtual 2-articulation type work front is not aligned with the first articulation 15 of the 3-articulation type work front, the positional relationship between both the first articulations can also be optionally set depending on the operating characteristics required.

Moreover, while in the above embodiments the fore end (bucket articulation) of the virtual second arm 14 of the virtual 2-articulation type work front is completely aligned with the fore end (bucket articulation) of the third arm of the 3-articulation type work front, both the fore ends may be offset to some extent. In such a case, so long as the positional relationship between both the fore ends is determined, processing can be performed in a like manner to the case where positions of both the fore ends are aligned with each other.

INDUSTRIAL APPLICABILITY

According to the present invention, operators having an ordinary skill can operate a 3-articulation type work front by using two control levers, which are similar to those employed in conventional 2-articulation type work fronts, with a similar operating feeling as obtained with the conventional 2-articulation type work fronts.

What is claimed is:

1. An operation control system for a 3-articulation type excavator (1) comprising an excavator body (99), a 3-articulation type work front (2) having a first arm (3) rotatably attached to said excavator body, a second arm (4) rotatably attached to said first arm and a third arm (5) rotatably attached to said second arm, and a hydraulic drive system (260, 261) including a first arm actuator (7) for driving said first arm, a second arm actuator (8) for driving said second arm, and a third arm actuator (9) for driving said third arm, wherein said operation control system comprises:

two operating means (11, 12) for operating said first arm (3), said second arm (4) and said third arm (5), and command calculating means (131,) including an imaginarily provided virtual 2-articulation type work front having a virtual first arm (13 or 13A) and a virtual second arm (14) and a preset relationship in movement between said virtual second arm (14) and said actual third arm (5) for determining respective command values for said actual first arm, said actual second arm and said actual third arm, such that said actual third arm (5) is moved correspondingly to movement of said virtual second arm (14) resulted when said two operating means (11, 12) functions respectively as first operating means (11) for said virtual first arm (13 or 13A) and second operating means (12) for said virtual second arm (14), and outputting those command values as driving command signals for said hydraulic drive system (260, 261).

2. An operation control system for a 3-articulation type excavator according to claim 1, wherein said command calculating means (131) sets the relationship in movement between said virtual second arm and said actual third arm such that said virtual second arm (14) and said actual third arm (5) are moved as if both arms constitute a rigid body together.

3. An operation control system for a 3-articulation type excavator according to claim 1, wherein said command calculating means (131) sets the relationship in movement between said virtual second arm and said actual third arm such that rotational angular speeds ($\omega_{br}$, $\omega_{ar}$) of said virtual second arm (14) provide a rotational angular speed of said actual third arm (5).

4. An operation control system for a 3-articulation type excavator according to claim 1, wherein said command calculating means (131) calculates respective first angular speed commands ($\omega_{b1}$, $\omega_{b2}$, $\omega_{b3}$) for said actual first arm (3), second arm (4) and third arm (5) from an angular speed command ($\omega_{br}$) by said first operating means (11) for said virtual first arm (13) based on the relationship in movement between said virtual second arm (14) and said actual third arm (5), calculates respective second angular speed commands ($\omega_{a1}$, $\omega_{a2}$, $\omega_{a3}$) for said actual first arm, second arm and third arm from an angular speed command ($\omega_{ar}$) by said second operating means (12) for said virtual second arm (14) based on the relationship in movement between said virtual second arm and said actual third arm, and determines respective command values ($\omega_1$, $\omega_2$, $\omega_3$) for said actual first arm, second arm and third arm by composing the first angular speed commands ($\omega_{b1}$, $\omega_{b2}$, $\omega_{b3}$) and the second angular speed commands ($\omega_{a1}$, $\omega_{a2}$, $\omega_{a3}$) for said actual first arm, second arm and third arm.

5. An operation control system for a 3-articulation type excavator according to claim 1, wherein a base end (15) of said virtual first arm (13A) of said imaginarily provided 2-articulation type work front is aligned with a base end (15) of said actual first arm (3), and wherein said command calculating means (131) determines, as a first angular speed command ($\omega_{b1}$) for said actual first arm (3), an angular speed command ($\omega_{br}$) by said first operating means (11) for said virtual first arm (13A), calculates respective second angular speed commands ($\omega_{a1}$, $\omega_{a2}$, $\omega_{a3}$) for said actual first arm (3), second arm (4) and third arm (5) from an angular speed command ($\omega_{ar}$) by said second operating means (12) for said virtual second arm (14) based on the relationship in movement between said virtual second arm (14) and said actual third arm (5), and determines respective command values ($\omega_1$, $\omega_2$, $\omega_3$) for said actual first arm, second arm and third arm by composing the first angular speed command ($\omega_{b1}$) for said actual first arm and the second angular speed commands ($\omega_{a1}$, $\omega_{a2}$, $\omega_{a3}$) for said actual first arm, second arm and third arm.

6. An operation control system for a 3-articulation type excavator according to claim 1, wherein said command calculating means (131) comprises:

means (160, 161, 162, 163, 164, 166) for calculating a target speed ($V_{b2}$) at a base end (16) of said actual third arm (5) from an angular speed command ($\omega_{br}$) by said first operating means (11) for said virtual first arm (13) based on the relationship in movement between said virtual second arm (14) and said actual third arm (5), and calculating respective first angular speed commands ($\omega_{b1}$, $\omega_{b2}$, $\omega_{b3}$) for said actual first arm (3), second arm (4) and third arm (5) from the target speed at the base end of said third arm and the angular speed command by said first operating means, means (139, 140, 145, 146, 148, 149) for calculating a target speed ($V_{a2}$) at the base end (16) of said actual third arm (5) from an angular speed command ($\omega_{ar}$) by said second operating means (12) for said virtual second arm (14) based on the relationship in movement between said virtual second arm and said actual third arm, and calculating respective second angular speed commands ($\omega_{a1}$, $\omega_{a2}$, $\omega_{a3}$) for said actual first arm (3), second arm (4) and third arm (5) from the target speed at the base end of said third arm and the angular speed command by said second operating means, and means (171, 172, 173) for determining respective command values ($\omega_1$, $\omega_2$, $\omega_3$) for said actual first arm, second arm and third arm by composing the first angular speed commands ($\omega_{b1}$, $\omega_{b2}$, $\omega_{b3}$) and the second angular speed commands ($\omega_{a1}$, $\omega_{a2}$, $\omega_{a3}$) for said actual first arm, second arm and third arm.

7. An operation control system for a 3-articulation type excavator according to claim 1, wherein said command calculating means includes posture detecting means (142, 143, 144 or 134, 136, 137, 138) for detecting a posture of said 3-articulation type work front (2), and calculates said command values ($\omega_1$, $\omega_2$, $\omega_3$) from posture information detected by said posture detecting means and angular speed commands by said first and second operating means (11, 12).

* * * * *